US005573457A

United States Patent [19]

Watts et al.

[11] Patent Number: 5,573,457

[45] Date of Patent: Nov. 12, 1996

[54] COIN WRAPPING SYSTEM WITH TOUCH SCREEN DEVICE

[75] Inventors: Gary P. Watts, Buffalo Grove; Richard A. Mazur, Naperville; John F. Weggesser, Lake in the Hills, all of Ill.

[73] Assignee: Cummins-Allison Corp., Mt. Prospect, Ill.

[21] Appl. No.: 399,770

[22] Filed: Mar. 7, 1995

[51] Int. Cl.[6] ..... B65B 11/02

[52] U.S. Cl. ..... 453/31; 53/212

[58] Field of Search ..... 453/21, 32; 53/212, 53/213, 532

[56] References Cited

U.S. PATENT DOCUMENTS

| | | | |
|---|---|---|---|
| 3,886,957 | 6/1975 | Ushio . | |
| 3,905,176 | 9/1975 | Ushio | 53/212 |
| 3,906,964 | 9/1975 | Ushio et al. . | |
| 3,908,338 | 9/1975 | Ushio | 53/212 |
| 3,925,966 | 12/1975 | Ushio | 53/212 |
| 3,938,303 | 2/1976 | Ushio et al. | 53/212 |
| 3,950,921 | 4/1976 | Itoda et al. . | |
| 4,089,151 | 5/1978 | Bergman et al. . | |
| 4,102,110 | 7/1978 | Iizuka et al. . | |
| 4,353,195 | 10/1982 | Nakamura | 53/54 |
| 4,409,773 | 10/1983 | Bergman et al. | 53/54 |
| 4,412,550 | 11/1983 | Watanabe et al. . | |
| 4,509,542 | 4/1985 | Watanabe et al. . | |
| 4,515,172 | 5/1985 | Nakamura et al. . | |
| 4,674,260 | 6/1987 | Rasmussen et al. | 53/212 |
| 4,718,218 | 1/1988 | Ristvedt | 53/532 |
| 4,782,328 | 11/1988 | Delinger . | |
| 4,806,709 | 2/1989 | Evans . | |
| 4,811,004 | 3/1989 | Person et al. . | |
| 4,835,938 | 6/1989 | Sakurai | 53/212 |
| 4,851,616 | 7/1989 | Wales et al. . | |
| 4,869,029 | 9/1989 | Takatani et al. | 53/52 |
| 4,896,481 | 1/1990 | Sentoku et al. | 53/501 |
| 4,897,984 | 2/1990 | Sentoku et al. | 53/501 |
| 4,928,094 | 5/1990 | Smith . | |
| 4,931,782 | 5/1990 | Jackson . | |
| 4,996,822 | 3/1991 | Truppe | 53/213 |
| 5,002,516 | 3/1991 | Watanabe et al. | 453/7 |
| 5,011,457 | 4/1991 | Takatani et al. | 453/61 |
| 5,105,186 | 4/1992 | May . | |
| 5,129,205 | 7/1992 | Rasmussen | 53/52 |
| 5,155,978 | 10/1992 | Watanabe | 53/532 |
| 5,183,142 | 2/1993 | Latchinian et al. | 194/206 |
| 5,184,115 | 2/1993 | Black et al. . | |
| 5,198,976 | 3/1993 | Form et al. . | |
| 5,231,381 | 7/1993 | Duwaer . | |
| 5,297,030 | 3/1994 | Vassigh et al. . | |
| 5,317,140 | 5/1994 | Dunthorn . | |
| 5,377,474 | 1/1995 | Kovacs et al. | 53/64 |
| 5,435,777 | 7/1995 | Takatani et al. | 453/31 |

*Primary Examiner*—F. J. Bartuska
*Attorney, Agent, or Firm*—Arnold, White & Durkee

[57] ABSTRACT

A coin wrapping system comprises (1) a coin wrapping mechanism forming loose coins into wrapped rolls of coins, (2) an operator interface panel, and (3) a controller coupling the operator interface panel to the coin wrapping mechanism. To provide the coin wrapping system with total flexibility in operation and other functions, the operator interface panel includes a display and a touch screen mounted over the display. The controller causes the display to display keys. The controller operably couples the touch screen to the displayed keys such that actuation of the touch screen at a position above one of the displayed keys causes the controller to perform a function associated with that displayed key. Preferably, the controller is operable, via the touch screen, in a plurality of modes including a basic operating mode, a memory recall mode, an adjustment for wrap quality mode, a diagnostics mode, and a programming mode. The basic operating mode preferably includes an error detection and recovery function. The controller causes the display to display keys associated with a selected one of the modes.

24 Claims, 24 Drawing Sheets

| | | | | | | | | | | |
|---|---|---|---|---|---|---|---|---|---|---|
| PENNIES | $ .01 | 50 | * | HALVES | $ .50 | 20 | * | 7 8 9 | | BATCH STOP |
| NICKELS | $ .05 | 20 | * | SBA | $ 1.00 | 25 | * | 4 5 6 | | _____ |
| NICKELS | $ .05 | 40 | * | TOKEN | $ 1.00 | 20 | * | 1 2 3 | | |
| DIMES | $ .10 | 50 | * | TOKEN | $ 5.00 | 20 | * | 0 | | |
| QUARTERS | $ .25 | 20 | * | COIN 1 | | | * | | | |
| QUARTERS | $ .25 | 40 | * | COIN 2 | | | * | | | WRAPPING 40 QUARTERS |
| | MODE | | | | | | | | | |
| WRAP * | | BAG * | | | SET-UP * | | | RETURN * | | |

FIG. 7

| | | | | | | | | | | |
|---|---|---|---|---|---|---|---|---|---|---|
| PENNIES | $ .01 | 50 | * | HALVES | $ .50 | 20 | * | 7 8 9 | | BATCH STOP |
| NICKELS | $ .05 | 20 | * | SBA | $ 1.00 | 25 | * | 4 5 6 | | 50 |
| NICKELS | $ .05 | 40 | * | TOKEN | $ 1.00 | 20 | * | 1 2 3 | | |
| DIMES | $ .10 | 50 | * | TOKEN | $ 5.00 | 20 | * | 0 | | |
| QUARTERS | $ .25 | 20 | * | COIN 1 | | | * | | | |
| QUARTERS | $ .25 | 40 | * | COIN 2 | | | * | | | SETTING UP LOAD COIN AND PAPER |
| | MODE | | | | | | | | | |
| WRAP * | | BAG * | | | SET-UP * | | | RETURN * | | |

FIG. 8

| | | | | | |
|---|---|---|---|---|---|
| START | * | STOP | * | DENOMINATION | 40 QUARTERS |
| CLEAR | * | RESET | * | TOTAL PIECES | 0 |
| MENU | * | DENOM | * | TOTAL ROLLS | 0 |
| ADD | * | | | STATUS | WRAPPING |

FIG. 9

| | | | | | |
|---|---|---|---|---|---|
| START | * | STOP | * | DENOMINATION | 40 QUARTERS |
| CLEAR | * | RESET | * | TOTAL PIECES | 20,040 |
| MENU | * | DENOM | * | TOTAL ROLLS | 501 |
| ADD | * | | | STATUS | STOPPED |

FIG. 10

| | | | | | | | | | | | |
|---|---|---|---|---|---|---|---|---|---|---|---|
| PENNIES | $ .01 | 50 | * | HALVES | $ .50 | 20 | * | 7 | 8 | 9 | BATCH STOP |
| NICKELS | $ .05 | 20 | * | SBA | $ 1.00 | 25 | * | 4 | 5 | 6 | 1000 |
| NICKELS | $ .05 | 40 | * | TOKEN | $ 1.00 | 20 | * | 1 | 2 | 3 | |
| DIMES | $ .10 | 50 | * | TOKEN | $ 5.00 | 20 | * | | 0 | | |
| QUARTERS | $ .25 | 20 | * | COIN 1 | | | * | | | | |
| QUARTERS | $ .25 | 40 | * | COIN 2 | | | * | | | | SETTING UP LOAD COIN ATTACH BAG |
| | MODE | | | | | | | | | | |
| WRAP * | | BAG * | | | SET-UP * | | | RETURN * | | | |

FIG. 11

| | | | | | |
|---|---|---|---|---|---|
| START | * | STOP | * | DENOMINATION | 1000 PENNIES |
| CLEAR | * | RESET | * | TOTAL PIECES | 0 |
| MENU | * | DENOM | * | TOTAL BAGS | 0 |
| ADD | * | | | STATUS | BAGGING |

FIG. 12

| | | | | | |
|---|---|---|---|---|---|
| START | * | STOP | * | DENOMINATION | 40 QUARTERS |
| CLEAR | * | RESET | * | TOTAL PIECES | 25,588 |
| MENU | * | DENOM | * | TOTAL ROLLS | 639 |
| ADD | * | | | STATUS | COIN JAM IN STACKER |

FIG. 13

| | | | |
|---|---|---|---|
| START * | STOP * | DENOMINATION | 40 QUARTERS |
| CLEAR * | RESET * | TOTAL PIECES | 30,000 |
| MENU * | DENOM * | TOTAL ROLLS | 750 |
| ADD * | | STATUS | STOPPED |

FIG. 15

| | | | |
|---|---|---|---|
| START * | STOP * | DENOMINATION | 40 QUARTERS |
| CLEAR * | RESET * | TOTAL PIECES | 30,000 |
| MENU * | DENOM * | TOTAL ROLLS | 750 |
| ADD * | | STATUS | CLEARING LOOSE COINS FROM MACHINE |

FIG. 16

| | | | | | |
|---|---|---|---|---|---|
| START | * | STOP | * | DENOMINATION | 40 QUARTERS |
| CLEAR | * | RESET | * | TOTAL PIECES | 30,000 |
| MENU | * | DENOM | * | TOTAL ROLLS | 750 |
| ADD | * | | | STATUS | ARE YOU SURE? YOU ARE CLEARING TOTALS |

FIG. 17

| | | | | | |
|---|---|---|---|---|---|
| START | * | STOP | * | DENOMINATION | 40 QUARTERS |
| CLEAR | * | RESET | * | TOTAL PIECES | 30,000 |
| MENU | * | DENOM | * | TOTAL ROLLS | 750 |
| ADD | * | | | STATUS | COINS CLEARED. PRESS START OR DENOM. |

FIG. 18

| | | | | | |
|---|---|---|---|---|---|
| START | * | STOP | * | DENOMINATION | 40 QUARTERS |
| CLEAR | * | RESET | * | TOTAL PIECES | 0 |
| MENU | * | DENOM | * | TOTAL ROLLS | 0 |
| ADD | * | | | STATUS | TOTALS CLEARED. PRESS START OR DENOM. |

FIG. 19

| | | | | | |
|---|---|---|---|---|---|
| START | * | STOP | * | DENOMINATION | 40 QUARTERS |
| CLEAR | * | RESET | * | TOTAL PIECES | 30,000 |
| MENU | * | DENOM | * | TOTAL ROLLS | 750 |
| ADD | * | | | STATUS | TOTALS ADDED TO MEMORY |

FIG. 20

MEMORY RECALL *

ADJUSTMENTS FOR BETTER WRAP *

SERVICE DIAGNOSTICS *
(Service Only)

PROGRAM CHANGES * RETURN
(Service Only)

FIG. 22

| | | | | | | | |
|---|---|---|---|---|---|---|---|
| PENNIES | $ .01 | 50 | * | HALVES | $ .50 | 20 | * |
| NICKELS | $ .05 | 20 | * | SBA | $ 1.00 | 25 | * |
| NICKELS | $ .05 | 40 | * | TOKEN | $ 1.00 | 20 | * |
| DIMES | $ .10 | 50 | * | TOKEN | $ 5.00 | 20 | * |
| QUARTERS | $ .25 | 20 | * | COIN 1 | | | * |
| QUARTERS | $ .25 | 40 | * | COIN 2 | | | * |

DENOMINATION
40 QUARTERS

TOTAL PIECES
1,320,000

TOTAL ROLLS
33,000

ALL DENOMINATIONS * RETURN * CLEAR TOTALS *

FIG. 23

| | | | | | | | |
|---|---|---|---|---|---|---|---|
| PENNIES | $ .01 | 50 | * | HALVES | $ .50 | 20 | * |
| NICKELS | $ .05 | 20 | * | SBA | $ 1.00 | 25 | * |
| NICKELS | $ .05 | 40 | * | TOKEN | $ 1.00 | 20 | * |
| DIMES | $ .10 | 50 | * | TOKEN | $ 5.00 | 20 | * |
| QUARTERS | $ .25 | 20 | * | COIN 1 | | | * |
| QUARTERS | $ .25 | 40 | * | COIN 2 | | | * |

DENOMINATION ALL

TOTAL PIECES 11,320,000

TOTAL ROLLS 251,555

ALL DENOMINATIONS * RETURN * CLEAR TOTALS *

FIG. 24

| | | | | | | | |
|---|---|---|---|---|---|---|---|
| PENNIES | $ .01 | 50 | * | HALVES | $ .50 | 20 | * |
| NICKELS | $ .05 | 20 | * | SBA | $ 1.00 | 25 | * |
| NICKELS | $ .05 | 40 | * | TOKEN | $ 1.00 | 20 | * |
| DIMES | $ .10 | 50 | * | TOKEN | $ 5.00 | 20 | * |
| QUARTERS | $ .25 | 20 | * | COIN 1 | | | * |
| QUARTERS | $ .25 | 40 | * | COIN 2 | | | * |

DENOMINATION ALL

TOTAL PIECES 11,320,000

TOTAL ROLLS 251,555

ARE YOU SURE ? YOU ARE CLEARING TOTALS

ALL DENOMINATIONS * RETURN * CLEAR TOTALS *

FIG. 25

| | | | | | | |
|---|---|---|---|---|---|---|
| PENNIES | $ .01 50 | * | HALVES | $ .50 20 | * | DENOMINATION ALL |
| NICKELS | $ .05 20 | * | SBA | $ 1.00 25 | * | |
| NICKELS | $ .05 40 | * | TOKEN | $ 1.00 20 | * | TOTAL PIECES 0 |
| DIMES | $ .10 50 | * | TOKEN | $ 5.00 20 | * | TOTAL ROLLS 0 |
| QUARTERS | $ .25 20 | * | COIN 1 | | * | |
| QUARTERS | $ .25 40 | * | COIN 2 | | * | ALL TOTALS CLEAR |
| ALL DENOMINATIONS | | * | RETURN | | * | CLEAR TOTALS * |

FIG. 26

| | | | | | | |
|---|---|---|---|---|---|---|
| | DENOMINATION | | 40 | | QUARTERS | |
| DIAMETER | WIDER | * | NARROWER | * | SETTING | 0 |
| THICKNESS | THICKER | * | THINNER | * | SETTING | 0 |
| PAPER FEED | LONGER | * | SHORTER | * | SETTING | 0 |
| | | | RETURN | * | | |

FIG. 27

| | | | | | | |
|---|---|---|---|---|---|---|
| | DENOMINATION | | 40 | | QUARTERS | |
| DIAMETER | WIDER | * | NARROWER | * | SETTING | +.5 |
| THICKNESS | THICKER | * | THINNER | * | SETTING | 0 |
| PAPER FEED | LONGER | * | SHORTER | * | SETTING | +2 |
| | | RETURN | * | | | |

FIG. 28

| | | | | |
|---|---|---|---|---|
| VOLTAGES | GOOD | COIN TABLE FOR. | * | 1 |
| COUNT SENSOR | 0 | COIN TABLE REV. | * | 0 |
| LEVEL SENSOR | 1 | PAPER FEED MTR. | * | 0 |
| RESTEP SENSOR | 0 | CONVEYOR BELT | * | 0 |
| HOME SENSOR | 0 | WRAP ROLLER MTR. | * | 0 |
| ENCODER SENSOR | 0 | STACKER MTR. CONT. | * | 0 |
| PAPER SENSOR | 0 | STACKER MTR. STEP | * | 0 |
| PAPER FEED ENCODER | 0 | SHUTTER SOLENOID | * | 0 |
| TOP DOOR SWITCH | 0 | COIN STOPPER | * | 1 |
| FRONT DOOR SWITCH | 0 | COIN FEED MTR. | * | 1 |
| | | COIN FED CLUTCH | * | 1 |
| RETURN | * | ADDITIONAL TESTS | | * |

FIG. 29

MAIN MOTOR CONT. *

MAIN MOTOR STEPPING * POSITION _____ HEX _____

| | | PLUS | MINUS | | | |
|---|---|---|---|---|---|---|
| DIAMETER ADJUSTMENT | * | * | * | POSITION | _____ | _____ |
| THICKNESS ADJUSTMENT | * | * | * | POSITION | _____ | _____ |

RETURN * METRIC *

FIG. 30

ADDRESS (HEX) * _____

CONTENTS (HEX) * _____

| | | | |
|---|---|---|---|
| 7 | 8 | 9 | A |
| 4 | 5 | 6 | B |
| 1 | 2 | 3 | C |
| 0 | D | E | F |

RETURN * ENTER *

FIG. 31

| | | | |
|---|---|---|---|
| ADDRESS (HEX) | * | 035B | 7 8 9 A |
| | | | 4 5 6 B |
| | | | 1 2 3 C |
| CONTENTS (HEX) | * | 29 | 0 D E F |
| RETURN * | | | ENTER * |

FIG. 32

COIN WRAPPING SYSTEM WITH TOUCH SCREEN DEVICE

FIELD OF THE INVENTION

The present invention relates generally to coin wrapping systems for forming coin rolls. More particularly, the present invention relates to a coin wrapping system employing a touch screen device.

BACKGROUND OF THE INVENTION

Coin wrapping mechanisms automate the process of forming loose coins into wrapped rolls of coins. Coin wrapping machines typically include two or more rollers that hold a stack of coins in position to be wrapped. While the rollers hold the stack of coins in the proper position, a wrapping medium, such as adhesively backed paper or plastic, is wrapped about the coin roll. Typically, the rollers of coin wrapping machines are adjustable to allow coins of different diameters to be effectively wrapped. Exemplary coin wrapping machines which are in commercial use today are shown in U.S. Pat. Nos. 3,886,957; 3,905,176; 3,906,964; 3,908,338; 3,925,966; 3,938,303; 3,950,921; 4,089,151; 4,102,110; and 4,412,550.

In existing coin wrapping mechanisms, an operator interface panel uses a conventional mechanical keyboard with depressible keys to operate the coin wrapping mechanism and to retrieve information about the coin wrapping mechanism and coins processed therethrough. A display monitor adjacent the mechanical keyboard displays the status of the coin wrapping mechanism. A major drawback of existing coin wrapping mechanisms is that the operator interface panel provides an operator with limited flexibility in operation, error display and recovery, diagnostics, and programming. The mechanical keyboard is relatively unfriendly to the operator. The operator cannot easily customize the mechanical keyboard or the display monitor to best suit the needs of the operator. From the perspective of a manufacturer, the operator interface panel is disadvantageous because modifications to the interface panel involve changing the hardware associated with the interface panel. Hardware modifications are relatively time-consuming and expensive. As a result, the manufacturer cannot easily correct design errors, make field updates, or produce coin wrapping mechanisms dedicated to special environments.

SUMMARY OF THE INVENTION

In one particular embodiment of the present invention, a coin wrapping system comprises (1) a coin wrapping mechanism for forming loose coins into wrapped rolls of coins, (2) an operator interface panel, and (3) a controller coupling the operator interface panel to the coin wrapping mechanism. To provide the coin wrapping system with total flexibility in operation and other functions, the operator interface panel includes a display and a touch screen mounted over the display. The controller causes the display to display keys. The controller operably couples the touch screen to the displayed keys such that actuation of the touch screen at a position above one of the displayed keys causes the controller to perform a function associated with that displayed key. Preferably, the controller is operable, via the touch screen, in a plurality of modes including a basic operating mode, a memory recall mode, an adjustment for wrap quality mode, a diagnostics mode, and a programming mode. The basic operating mode preferably includes an error detection and recovery function. The controller causes the display to display keys associated with a selected one of the modes.

BRIEF DESCRIPTION OF THE DRAWINGS

Other objects and advantages of the invention will become apparent upon reading the following detailed description and upon reference to the drawings in which:

FIG. 7 is a diagrammatic representation of the touch screen device in FIG. 5 showing a denomination select and mode set-up screen after the operator powers up the coin wrapping system;

FIG. 8 is a diagrammatic representation of the touch screen device in FIG. 5 showing a denomination select and mode set-up screen after the operator sets up the coin wrapping system for wrapping;

FIG. 9 is a diagrammatic representation of the touch screen device in FIG. 5 showing an operational screen after the controller in FIG. 3 configures the coin wrapping system for wrapping;

FIG. 10 is a diagrammatic representation of the touch screen device in FIG. 5 showing an operational screen after the coin wrapping system has stopped wrapping or bagging;

FIG. 11 is a diagrammatic representation of the touch screen device in FIG. 5 showing a denomination select and mode set-up screen after the operator sets up the coin wrapping system for bagging;

FIG. 12 is a diagrammatic representation of the touch screen device in FIG. 5 showing an operational screen after the controller in FIG. 3 configures the coin wrapping system for bagging;

FIG. 13 is a diagrammatic representation of the touch screen device in FIG. 5 showing an operational screen after the coin wrapping system stops due to an operational error;

FIG. 15 is a diagrammatic representation of the touch screen device in FIG. 5 showing an operational screen after the coin wrapping system has stopped wrapping or bagging;

FIG. 16 is a diagrammatic representation of the touch screen device in FIG. 5 showing an operational screen while coins are being cleared from a stacker of the coin wrapping system;

FIG. 17 is a diagrammatic representation of the touch screen device in FIG. 5 showing an operational screen requesting confirmation that current coin totals should be cleared from memory;

FIG. 18 is a diagrammatic representation of the touch screen device in FIG. 5 showing an operational screen indicating that coins have been cleared from the stacker of the coin wrapping system;

FIG. 19 is a diagrammatic representation of the touch screen device in FIG. 5 showing an operational screen indicating that current coin totals have been cleared from memory;

FIG. 20 is a diagrammatic representation of the touch screen device in FIG. 5 showing an operational screen indicating that current coin totals have been added to memory;

FIG. 22 is a diagrammatic representation of the touch screen device in FIG. 5 showing a menu select screen used to enter the memory recall mode, adjustment for wrap quality mode, diagnostics mode, and programming mode;

FIG. 23 is a diagrammatic representation of the touch screen device in FIG. 5 showing a memory recall screen employed in the memory recall mode after the operator has pressed a particular denomination key;

FIG. 24 is a diagrammatic representation of the touch screen device in FIG. 5 showing the memory recall screen after the operator has pressed an all denominations key;

FIG. 25 is a diagrammatic representation of the touch screen device in FIG. 5 showing the memory recall screen requesting confirmation that cumulative coin totals should be cleared from memory;

FIG. 26 is a diagrammatic representation of the touch screen device in FIG. 5 showing the memory recall screen indicating that cumulative coin totals have been cleared from memory;

FIG. 27 is a diagrammatic representation of the touch screen device in FIG. 5 showing default settings on an adjustments for wrap quality screen employed in the adjustments for wrap quality mode;

FIG. 28 is a diagrammatic representation of the touch screen device in FIG. 5 showing modified settings on the adjustments for wrap quality screen;

FIG. 29 is a diagrammatic representation of the touch screen device in FIG. 5 showing a first diagnostics screen employed in the diagnostics mode;

FIG. 30 is a diagrammatic representation of the touch screen device in FIG. 5 showing a second diagnostics screen employed in the diagnostics mode;

FIG. 31 is a diagrammatic representation of the touch screen device in FIG. 5 showing a program changes screen employed in the programming mode prior to selecting a hex address to make programming changes; and FIG. 32 is a diagrammatic representation of the much screen device in FIG. 5 showing the program changes screen after selecting a hex address to make programming changes.

Figure 1:
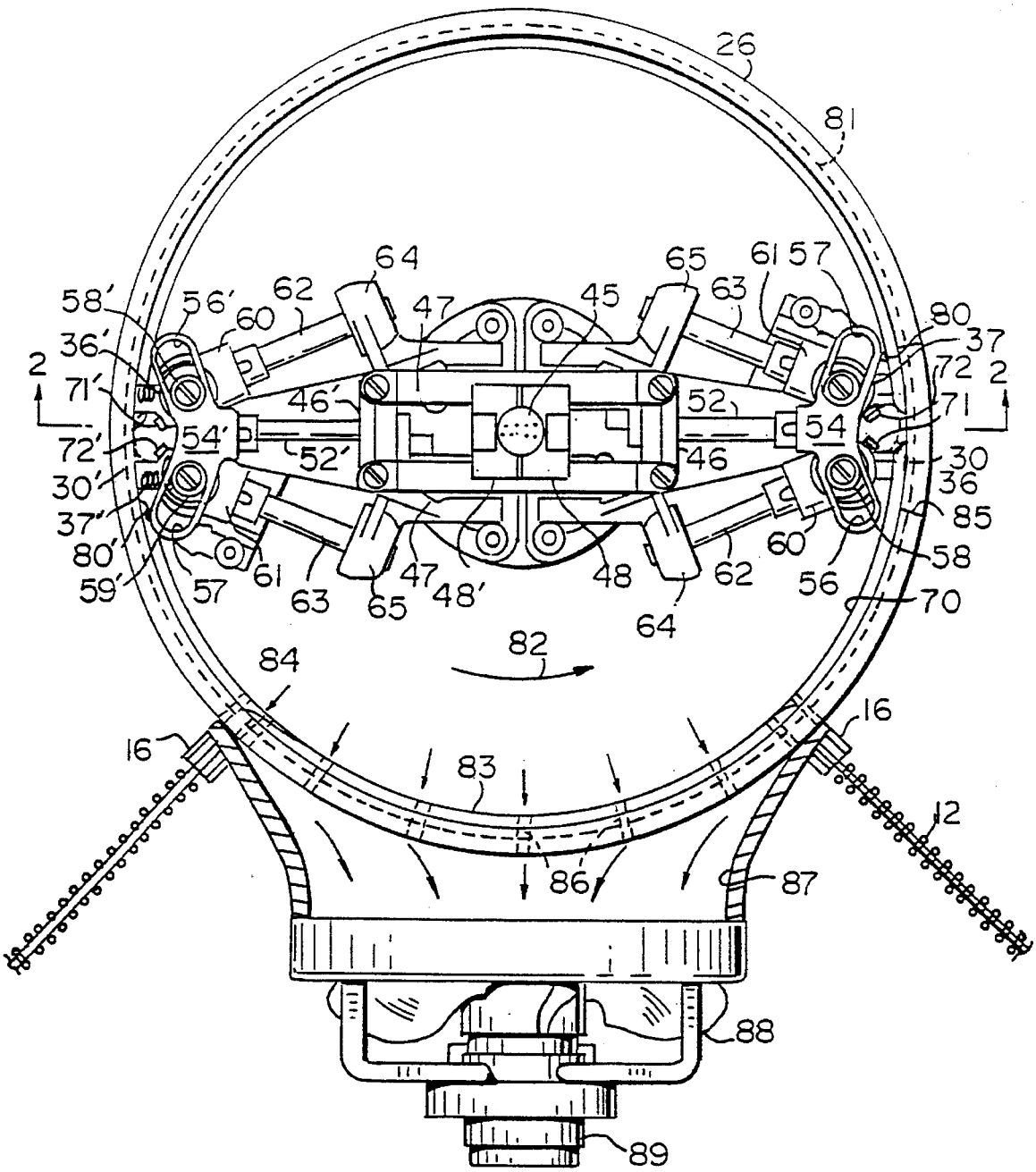
FIG. 1 is a top view of a coin wrapping mechanism preferred for use with a coin wrapping system embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF THE PREFERRED EMBODIMENT

For purposes of illustration, the coin wrapping system with touch screen device of the present invention is described for use with the coin wrapping mechanism disclosed in U.S. Pat. Nos. 4,674,260 and 5,129,205, which are hereby incorporated by reference. It should be understood that this is a preferred embodiment of the present invention, and that it may take various other forms as needed to be adapted to other types of coin wrapping mechanisms. Other exemplary coin wrapping mechanisms suitable for use with the touch screen device described below are disclosed in U.S. Pat. Nos. 5,155,978; 5,011,457; 5,002,516; 4,996,822; 4,897,984; 4,896,481; 4,869,029; 4,835,938; 4,718,218; 4,509,542; 4,409,773; and 4,353,195. Each of these enumerated patents is incorporated herein by reference.

Figure 2:
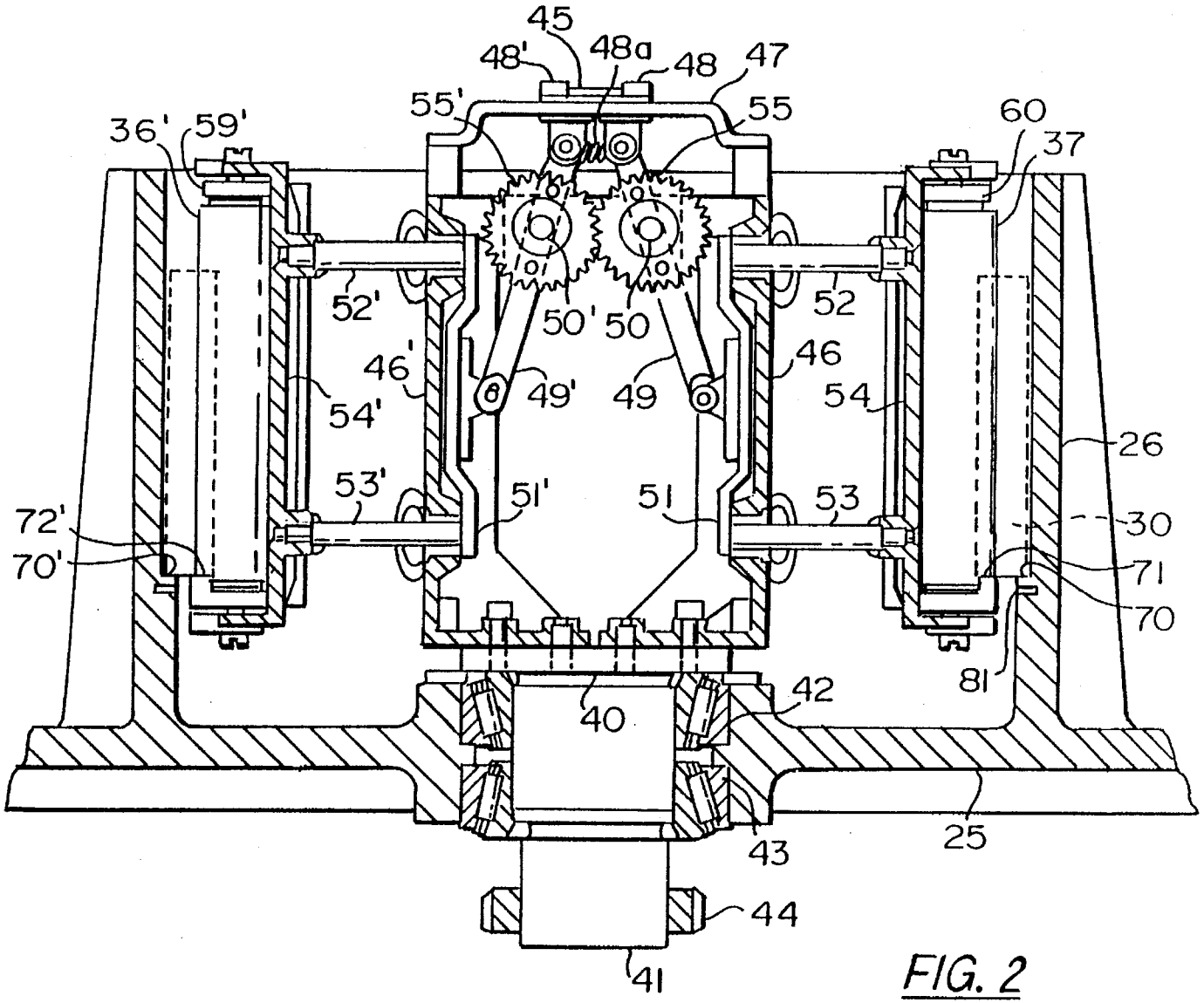
FIG. 2 is a section taken generally along line 2—2 in FIG. 1.

Turning now to the drawings, FIGS. 1 and 2 illustrate detailed elements of the preferred coin wrapping mechanism. The preferred coin wrapping mechanism in FIGS. 1 and 2 employs a conventional coin feed and stacking arrangement (not shown) which forms a coin stack 30 to be wrapped with the coin wrapping mechanism. In this coin feed and stacking arrangement, coins of a selected denomination from a bag of loose coins are loaded into a coin hopper. The coin hopper delivers the loaded coins to a conveyor belt, which, in turn, deposits the coins on a conventional turntable. As the turntable is rotated, the coins deposited on the top surface thereof tend to slide outwardly over the top surface due to centrifugal force. The centrifugal force drives the coins to the outer circumference of the turntable, where the coins are then carried off the turntable and onto a stationary coin track. A drive belt, mounted over the coin track, drives the coins downstream along the stationary coin track. The coins are driven downstream along the coin track in a single file and single layer. As described below, the width of the coin track is adjusted to be approximately equal to the diameter of the coins of the selected denomination. As the coins are driven downstream along the coin track, the coins pass a coin sensor which counts the individual coins. The coin track feeds a prescribed number of coins of the selected denomination, as counted by the coin sensor, to a conventional coin stacker/tube which stacks the prescribed number of coins in a controlled fashion to form the coin stack 30. The coin stack 30 may be formed by any of a variety of different coin stackers, such as the one described in Nakamura et al U.S. Pat. No. 4,515,172, which is incorporated herein by reference. Such coin stackers typically have a shutter which opens each time it is desired to load a new coin stack into the wrapping mechanism.

In the coin wrapping mechanism, the coin stack 30 is lowered into a cylindrical chamber 26. The cylindrical chamber 26 surrounds a rotatable portion 28 of the mechanism. The entire rotatable portion 28 of the wrapping mechanism is supported on a flange 40 on the end of a driven spindle 41 mounted for rotation in two sets of roller bearings 42 and 43 in the base plate 25 of the wrapping chamber 26. The lower end of the spindle 41 carries a gear 44 which is connected to a suitable drive means (e.g., a stepper motor) for rotating the spindle 41 in increments of 180 degrees.

As the spindle 41 and the base plate 45 are rotated, they carry with them a central frame formed by a pair of columns 46 and 46' which are rigidly fastened to the base plate 25 by machine screws. The upper ends of the columns 46 and 46' are connected by a crown 47 which also serves as a track for a pair of adjustment members 48 and 48' which are biased toward each other by a spring 48A. The tops of the adjustment members 48, 48' form a pair of adjustment lugs between which an elliptical cam 100 (FIG. 3) is inserted to space the members 48, 48' apart by a distance proportional to the diameter of the coins in a stack of coins to be wrapped. Thus, the members 48 and 48' are spaced apart along the track formed by the crown 47 by a maximum amount when spaced apart along the major axis of 102 (FIG. 4) of the elliptical cam 100, and by a minimum amount when spaced apart by the minor axis 104 (FIG. 4) of the elliptical cam 100. The precise function of the elliptical cam 100 will be fully explained in reference to FIGS. 3 and 4.

Each time the spacing of the adjustment members 48 and 48' is adjusted, the radical positions of the two pair of wrapping rollers 36, 37 and 36', 37' are automatically adjusted by a mechanism comprising a pair of control arms 49 and 49' mounted for pivotal movements about fixed shafts 50 and 50'; a pair of yokes 51 and 51' connecting the lower ends of the respective control arms 50 and 50' to the ends of respective pairs of sliding rods 52, 52' and 53, 53'; and a pair of brackets 54 and 54' fastened to the outer ends of the rods 52, 52' and 53, 53' for positioning the wrapping rollers 36, 37, and 36', 37'.

To interconnect the two halves of the adjustment mechanism connected to the two adjustment members 48 and 48', the shafts 50 and 50' carry two pairs of meshing gears 55 and 55'. Because of this gear connection, movement of either of the adjustment members 48 and 48' along the crown 47 results in a corresponding movement of the other adjustment member, thereby ensuring that the two halves of the adjustment mechanism are moved in synchronism with each other and by precisely the same amounts.

In order to properly position the wrapped rollers 36, 37 and 36', 37' in response to adjusting movement of the rods 52, 53 and 52', 53', the upper and lower ends of the brackets 54 and 54' form camming slots 56, 57 and 56', 57' (see FIG. 1). These camming slots receive cam followers 58, 59 and 58', 59' on the shafts of the respective wrapping rollers 36, 37 and 36', 37', so that the wrapping rollers are cammed to different positions determined by the shape of the camming slots 56, 57 and 56', 57' whenever the rods 52, 53 and 52', 53' are adjusted. Since the adjusting movement of the rods 52, 53 and 52', 53' is determined by the length between diametrically opposed edges of the elliptical cam 100 which is inserted between the two adjustment member 48 and 48', the camming slots 56, 57 and 56', 57' are designed to move the wrapping rollers to precisely the desired position for each different coin denomination. That is, the diameter of a circle touching the surfaces of the two rollers 36 and 37 and the inner wall of the cylinder called chamber 26 (see broken-line circles 30 and 30' in FIG. 1) should be just slightly larger than the diameter of the particular coin denomination to be wrapped.

To support the wrapping rollers in fixed vertical positions, each wrapping roller 36 and 37 is mounted on its own bracket 60 or 61, respectively. The shafts of the wrapping rollers extend through the horizontal arms of these brackets 60 and 61, and the brackets in turn are fastened to upper and lower pairs of guide rods 62 and 63 extending inwardly therefrom through corresponding bosses 64 and 65 on the comers of the support column 46. The rods 62 and 63 are slidably supported within the bosses 64 and 65 to permit the wrapping rollers 36 and 37 to move back and forth along the axes of these rods in response to the camming action described above. Of course, the other pair of wrapping rollers 36' and 37' are equipped with similar brackets 60' and 61' fastened to guide rods 62' and 63' extending through bosses 64' and 65'.

When the control arms 49, 49' are pivoted in response to rotation of the elliptical cam 100 between the two adjustment members 48, 48', the radical positions of the wrapping rollers 36, 37 and 36', 37' are automatically adjusted to accommodate stacks of coins of a predetermined denomination. The adjustability of this mechanism is universal in the sense that it can be stopped anywhere between its end limits, so that it can accommodate any number of different coins or tokens. This permits the same mechanism to be used for coins of different countries, for example. The space between the wrap rollers is set to accept a stack of coins by allowing a clearance around the stack of coins. This clearance allows for a variance in the coin diameter, maintains a uniform stack, and allows for a wrapping medium to be wrapped about the stack.

After the wrapping rollers 36, 37 and 36', 37' have been positioned to receive stacks of coins of the desired denomination, a stack of such coins is lowered into the cylindrical chamber 36. The stack of coins is supported between a set of three supports 70, 71 and 72 which engage the bottom of the coin stack 38 throughout the wrapping operation and permit the coin stack 30 to be rotated as it is rolled about the inner surface of the cylindrical chamber.

A driven sprocket belt 12, which is disposed about sprocket wheels 16, engages with an adhesively backed paper web 10 and pulls the paper web 10 upwardly through a slot (not shown) and onto the inner wall of the cylindrical chamber 26 that is lined with a resilient pad 83. To ensure that the paper remains against the pad 83, a light vacuum is preferably applied to the paper surface which faces the inner wall. As illustrated in FIG. 1, both the pad 83 and the corresponding portion of the inner wall are perforated by apertures 86 opening into a manifold 87 that leads to a suction fan 88. A motor 89 drives the fan 88 to exhaust air from the manifold 87 and thereby draws the paper web 10 firmly against the pad 83.

To effect the wrapping of a coin stack 30 after it has been deposited on the supports 70, 71, 72, the spindle 41 is rotated in a direction indicated by the arrow 82 in FIG. 1. This moves the wrapping rollers 36, 37 in the same direction, carrying the coin stack 30 with them along the inner surface of the cylindrical chamber 26 and across the adhesively coated surface of the paper web 10. The resilient pad 83 ensures that the paper web 10 is pressed into firm engagement with the coin stack 30. The leading edge 84 of the pad 83 is beveled so that the coin stack 30 rolls smoothly across the edge of the pad 83 and onto the paper web 10, thereby compressing the pad 83 so that the pad 83 applies biasing pressure on the paper web 10 to urge it against the coin stack 30. The pad 83 extends along the full circumferential length of the paper web 10, so that the biasing pressure is applied throughout the wrapping of the coin stack 30.

After the coin stack 30 has been rolled across the entire circumferential length of the paper web 10 by the orbiting movement of the wrapping rollers 36, 37, the spindle 41 continues to move the rollers to a positions diametrically opposed to the position where the coin stack 30 was initially loaded. This 180 degree movement of the wrapping rollers 36, 37 brings the wrapped roll of coins into register with an aperture 85 in the wail of the cylindrical wail of the chamber 26 through which the wrapped coin roll 30 can be discharged from the cylindrical chamber 26.

Figure 4:
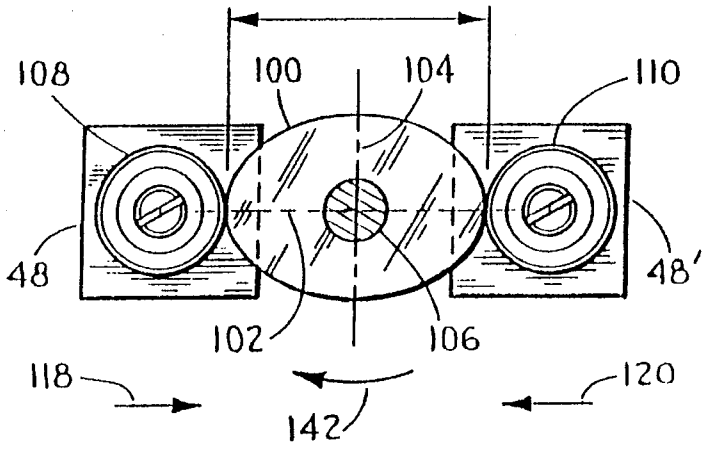
FIG. 4 is a section taken generally along line 4—4 in FIG. 3.
Figure 3:
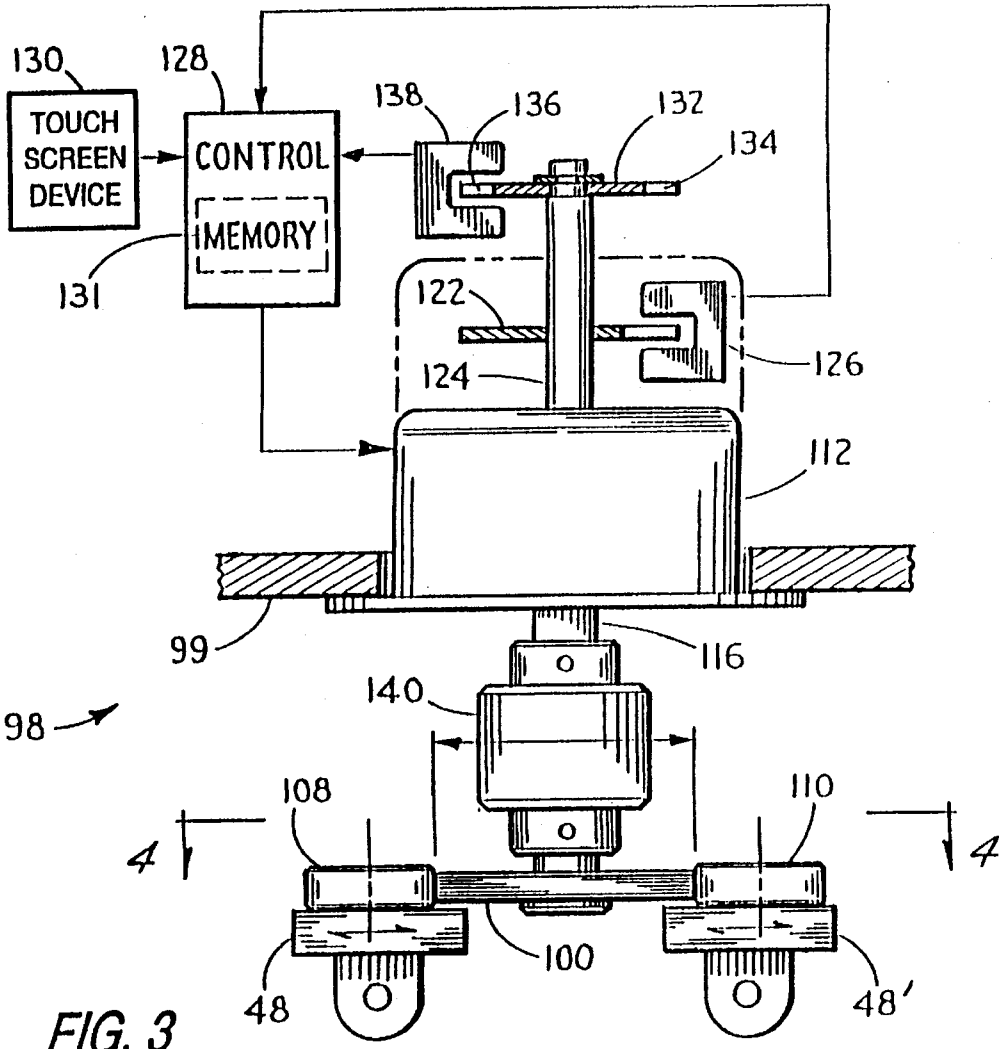
FIG. 3 is a side view of an automatic adjustment device for use with the coin wrapping mechanism in FIG. 1.

Referring now to FIGS. 3 and 4, there is illustrated an automatic device 98 for use with the coin wrapping mechanism. Preferably, the automatic adjustment device 98 is mounted above at least a portion of the rotatable portion 28 by a fixed housing 99. As previously stated, the elliptical cam 100 of the automatic adjustment device 98 is disposed between the adjustment members 48 and 48'.

The elliptical cam 100 is defined by a major axis 102 and a minor axis 104 which are perpendicular to one another and which intersect at the center of rotation 106 of the elliptical cam. The center of rotation 106 is axially aligned with the center of rotation of the rotatable portion 28 of the wrapping mechanism and with the mid-point between the sliding adjustment members 48 and 48'. The length of the major axis 102 represents the maximum adjustment limit of the elliptical cam 100, and the length of the minor axis 104 represents the minimum adjustment limit of the elliptical cam 100. Rotation of the cam 100 controllably moves the adjustment members 48, 48', and, thus, the wrapping rollers 36, 37, to any one of the infinite positions between the maximum and minimum limits.

The elliptical cam 100 is adapted to rotate with respect to the adjustment members 48 and 48'. Preferably, a roller cam follower 108, 110 is connected to each respective adjustment member 48, 48'. The addition of the roller cam followers 108, 110 reduces the friction and wear of the edge of the elliptical cam 100 when the cam 100 is rotated.

The center 106 of the elliptical cam 100 is operably connected to a motor 112. The motor 112 is adapted to rotate the cam 100 in at least one direction with respect to the adjustment members 48 and 48'. The motor 112 outputs rotational motion via a lower output shaft 116 which is operably connected to the center of rotation 106 of the elliptical cam 100. As the motor 112 rotates the cam 100, the distance between the adjustment members 48 and 48' changes in response to the changing distance between the diametrically opposed edges of the elliptical cam 100 that contact the cam followers 108 and 110. Preferably, the cam followers 108 and 110 are inwardly biased toward one another in the direction of arrows 118 and 120 in order to maintain contact between the diametrically opposed edges of the elliptical cam 100 and the cam followers 108 and 110.

The motor 112 includes means for monitoring its rotation, such as an encoder assembly 114. As the motor 112 rotates, an encoder disc 122 in the encoder assembly 114 rotates on an upper output shaft 124 of the motor 112. The encoder disc 122 includes a multitude of slots (not shown) about its outer periphery. A sensor 126 is disposed proximate the outer periphery of the encoder disc 122, and generates pulses as the slots in the outer periphery of the encoder disc 122 pass through the sensor 126. Preferably, the upper output shaft 124 also carries a home position disc 132 which includes two diametrically opposed slots 134 and 136 in its outer periphery. A sensor 138 is disposed proximate the outer periphery of the home position disc 132, and generates a pulse each time one of the slots 134, 136 is rotated through the sensor 138. The slots 134 and 136 are related to a specific position of the elliptical cam 100. As shown, the diametrically opposed slots 134 and 136 indicate that the elliptical cam 100 is positioned with its major axis 102 separating the adjustment members 48 and 48'.

An electronic controller 128 receives signals from the sensors 126 and 138. The pulses delivered by the sensors 126 and 138 are interpreted by the controller 128, and equated to distinct positions of the elliptical cam 100. By equating the number and timing of pulses to a given adjustment, the controller 128 can activate the motor 112 to selectively rotate the elliptical cam 100 to a predetermined position so that a coin having a preselected diameter between the lower and upper limits may be effectively wrapped in the wrapping mechanism. This is extremely useful if it is desirable to use the coin wrapping mechanism to wrap a previously unknown coin or token.

Preferably, the diameter of an unknown coin or token is entered into the electronic controller 128 via a touch screen device 130. The touch screen device 130 will be described in detail below. The controller 128 receives the diameter input from the touch screen device 130, and calculates the required clearances of the wrapping rollers 36, 37 for a coin of that diameter. Alternatively, since the controller 128 preferably includes read-only-memory 131, the controller 128 selects an appropriate clearance from a table or curve stored in the memory. The controller 128 then signals the motor 112 to rotate by a predetermined amount to accurately position the elliptical cam 100 so that the wrapping rollers 36 and 37 are adjusted to properly accept a stack of coins of the particular diameter. A particular known type of coin may also be entered on the touch screen device 130. In this case, the memory 131 stores a predetermined clearance for that coin and the amount that the motor 112 should be turned in order to properly position the elliptical cam 100, and, thus, the wrapping rollers 36 and 37. Advantageously, the read-only-memory is replaceable, to that one memory could be used to store the appropriate settings for coins of one country, and another memory could be used to store the appropriate settings for coins of a different country.

Rotation of the motor 112 by 90 degrees adjusts the wrapping rollers 36 and 37 from their upper limits to their lower limit. Each time a different coin denomination is to be wrapped, the proper code is entered on the touch screen device 130 and the proper position of the motor is determined by the controller 128. The controller 128 signals the motor 112 to rotate until a signal is received from the sensor 138, which indicates that the elliptical cam 100 is in a known position. The controller 128 then signals the motor 112 to rotate by a predetermined amount which is accurately controlled via the feedback provided by the encoding disc 122 and associated sensor 126.

Figure 5:
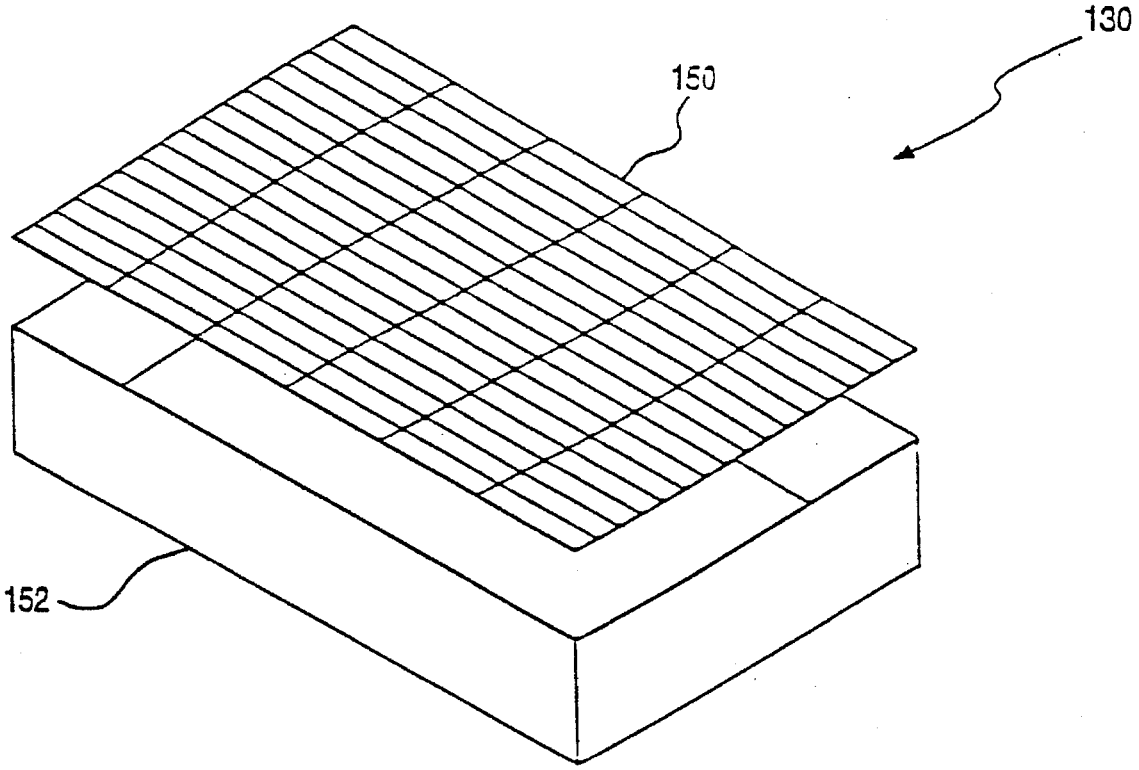
FIG. 5 is an exploded perspective view of a touch screen device preferred for use with the coin wrapping system embodying the present invention.

Referring now to FIG. 5, the touch screen I/O device 130 includes a touch screen 150 mounted over a graphics display 152. In one embodiment, the display 152 is a liquid crystal display (LCD) with backlighting, and the display has 128 vertical pixels and 256 horizontal pixels. The display 152 contains a built-in character generator which permits the display 152 to display text and numbers having font and size pre-defined by the manufacturer of the display. Moreover, the controller 128 (FIG. 3) is programmed to permit the loading and display of custom fonts and shapes (e.g., key outlines) on the display 152. The display 152 is commercially available from Stanley Electric Company, Ltd., Equipment Export Section, of Tokyo, Japan.

In one embodiment, the touch screen 150 is an X-Y matrix touch screen forming a matrix of touch responsive points. The touch screen 150 includes two closely spaced but normally separated layers of optical grade polyester film each having a set of parallel transparent conductors. The sets of conductors in the two spaced polyester sheets are oriented at fight angles to each other so when superimposed they form a grid. Along the outside edge of each polyester layer is a bus which interconnects the conductors supported on that layer. In this manner, electrical signals from the conductors are transmitted to the controller 128. When pressure from a finger or stylus is applied to the upper polyester layer, the set of conductors mounted to the upper layer is deflected downward into contact with the set of conductors mounted to the lower polyester layer. The contact between these sets of conductors acts as a mechanical closure of a switch element to complete an electrical circuit which is detected by the controller 128 through the respective buses at the edges of the two polyester layers, thereby providing a means for detecting the X and Y coordinates of the switch closure. A matrix touch screen 150 of the above type is commercially available from Dynapro Thin Film Products, Inc. of Milwaukee, Wis. As illustrated in FIG. 6, the touch screen 150 forms a matrix of optically transparent switches having X columns and Y rows. If desired, the controller 128 may be programmed to combine one or more adjacent switch elements into a single switch, such that activation of any of the combined switch elements activates the switch.

Although the touch screen 150 uses an X-Y matrix of optically transparent switches to detect the location of a touch, alternative types of touch screens may be substituted for the touch screen 150. These alternative touch screens use such well-known techniques as crossed beams of infrared light, acoustic surface waves, capacitance sensing, and resistive membranes to detect the location of a touch. The structure and operation of the alternative touch screens are described and illustrated, for example, in U.S. Pat. Nos. 5,317,140; 5,297,030; 5,231,381; 5,198,976; 5,184,115; 5,105,186; 4,931,782; 4,928,094; 4,851,616; 4,811,004; 4,806,709; and 4,782,328, which are incorporated herein by reference.

The controller 128 is programmed to display various sets of "keys" on the display 152. A key is preferably displayed on the display 152 in the form of either an asterisk "*" or key outline. If the key is displayed as an asterisk "*", a key legend defining the function of the key is positioned adjacent the asterisk "*". If the key is displayed as an outline (e.g., rectangle, circle, or other shape), the key legend is positioned either within the key outline or adjacent the key outline. Each legend designates the function of its associated key. The controller 128 links the functions of the much screen switches to the keys displayed beneath respective ones of the switches. As a result, pressing the much screen 150 at a location above a displayed key causes the controller 128 to perform the function associated with that displayed key. Hereinafter, references to pressing a displayed key denote that an operator is pressing the touch screen 150 at a location above the displayed key. In conjunction with the touch screen 150 and display 152, the controller 128 can enter various modes of operation and information retrieval, including a basic operating mode, a memory recall mode, an adjustment for wrap quality mode, a diagnostics mode, and a programming mode. Each of these modes is described in detail below.

Figure 6A:
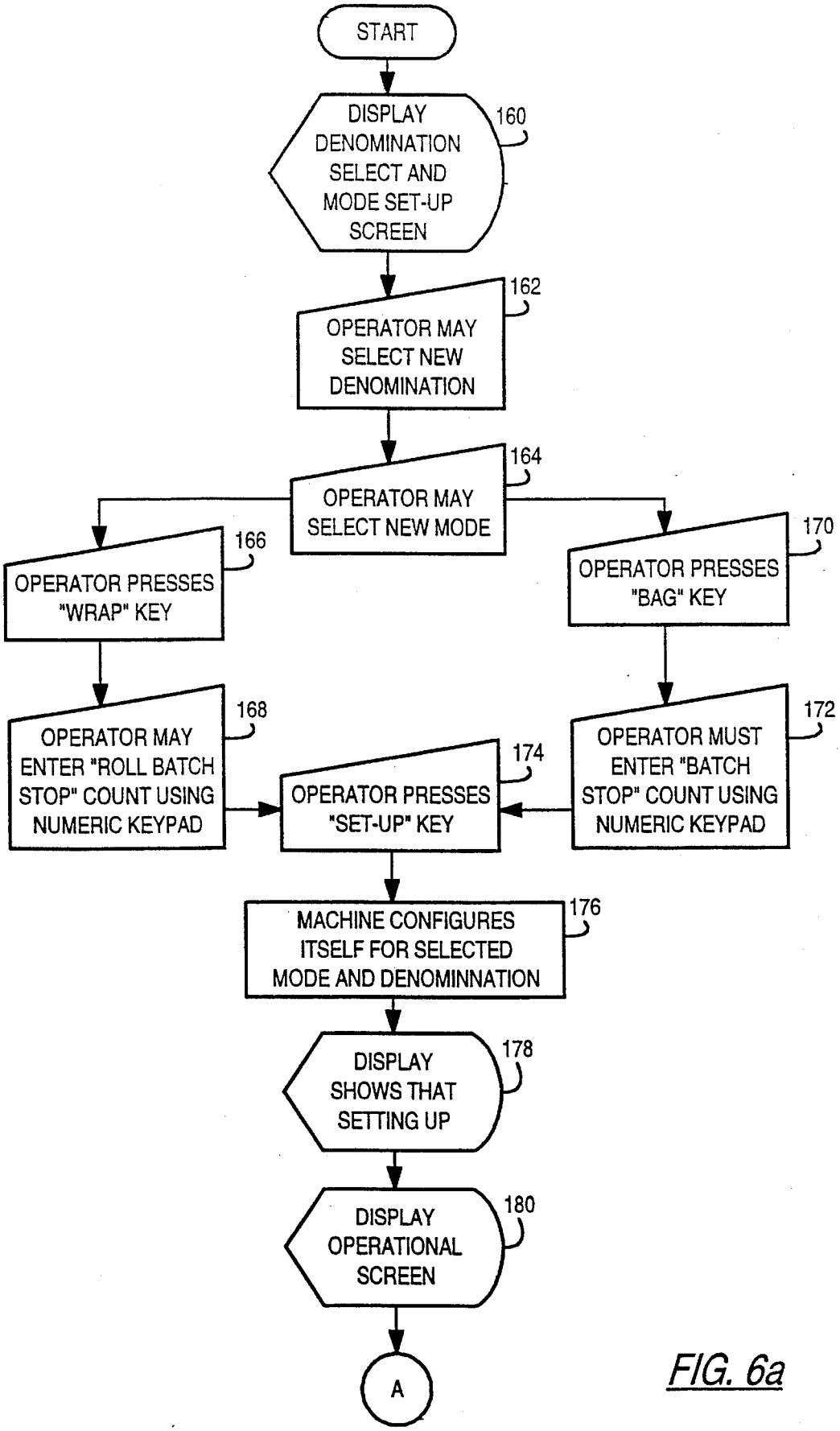
FIGS. 6*a–b* is a flow diagram showing an interactive process of configuring the coin wrapping system for wrapping or bagging while the controller in FIG. 3 is in a basic operating mode.
Figure 6B:
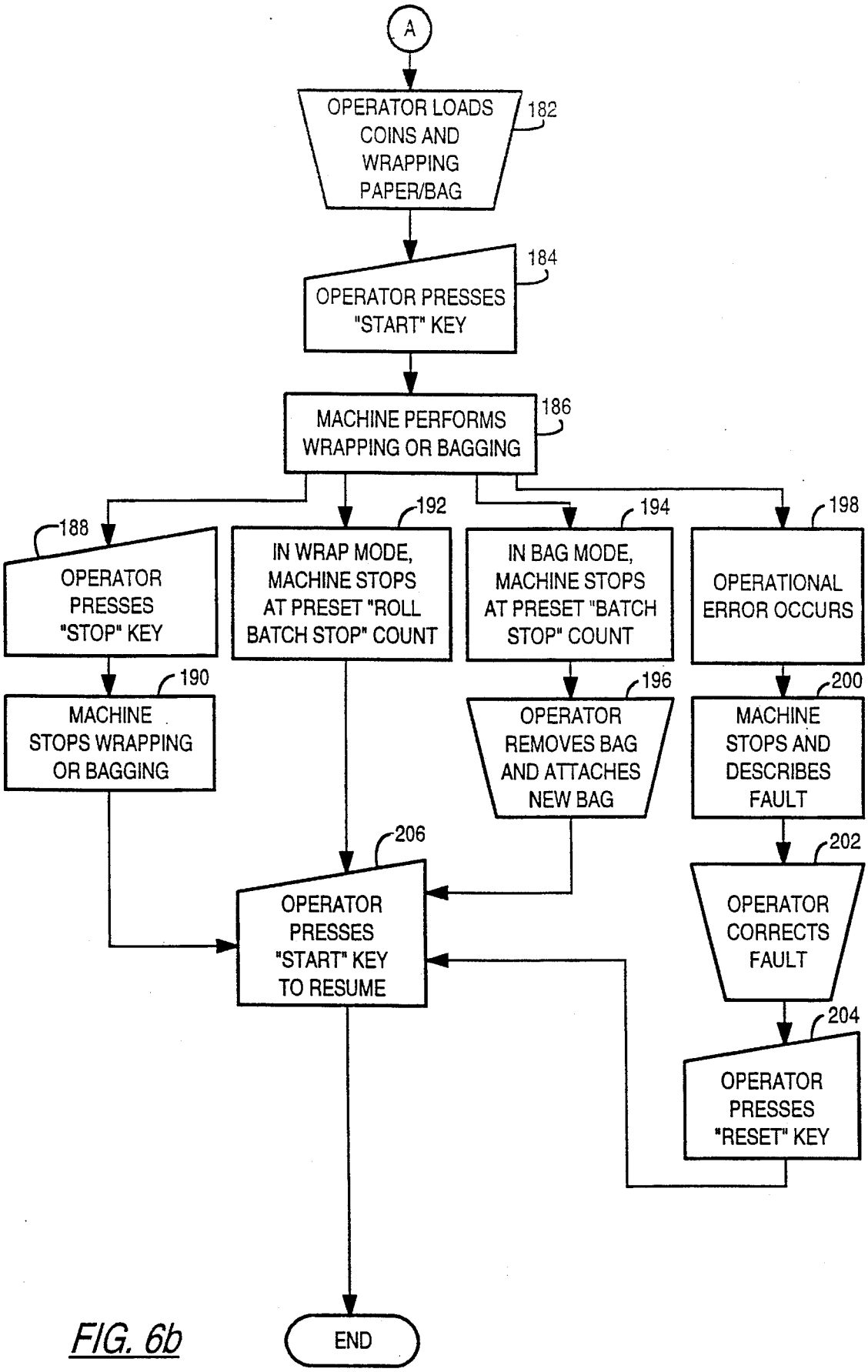

Referring to FIGS. 6*a–b*, in response to powering up the coin wrapping system, the display 152 displays a denomination select and mode set-up screen as depicted in FIG. 7 (step 160). The screen displayed on the display 152 in FIG. 7 allows direct selection of a denomination to be wrapped or bagged by pressing the appropriate denomination key (step 162). The display 152 shows all available denominations which can be selected by the operator. To maintain the current denomination, the operator does not press a new denomination key different from the one already selected. Next, the operator may select either a wrapping or bagging mode, where wrapping is the default mode (step 164). In the bagging mode, coins driven downstream along the coin track described previously are fed directly into a bag chute instead of the aforementioned coin stacker. While the machine is bagging, the bag chute has a bag attached to the exit end thereof to capture coins fed into the bag chute.

To select the wrapping mode, the operator presses the "WRAP" key (step 166). In the wrapping mode, the operator may enter a "roll batch stop" count via the ten-key numeric key pad on the display 152 to automatically stop the machine after the desired number of rolls have been wrapped (step 168). In FIG. 8, for example, the operator has set the machine to stop wrapping after 50 rolls. Alternatively, to select the bagging mode, the operator presses the "BAG" key (step 170). The operator must then enter a "batch stop" count via the numeric key pad on the display 152 (step 172). In FIG. 11, for example, the operator has set the machine to stop after counting 1000 coins. Leaving the "batch stop" count blank in the bagging mode causes the controller 128 to generate an alarm message on the display 152 stating that a batch stop is required.

After selecting either the wrapping or bagging mode, the operator presses the "SET-UP" key displayed on the denomination select and mode set-up screen in FIG. 7 (step 174). In response to pressing the "SET-UP" key, the controller 128 configures the machine for the selected denomination and mode (step 176) and the display 152 shows that the machine is setting itself up (step 178). If, for example, the operator has selected the wrapping mode, the display 152 indicates that the machine is "Setting Up" and requests the operator to "Load Coin and Paper" (see FIG. 8). Similarly, if the operator has selected the bagging mode, the display 152 indicates that the machine is "Setting Up" and requests the operator to "Load Coin and Attach Bag" (see FIG. 11).

After the controller 128 completes the set-up of the machine, the controller 128 displays an operational screen on the display 152 (step 180). In the wrapping mode the operational screen appears substantially as depicted in FIG. 9, and in the bagging mode the operational screen appears substantially as depicted in FIG. 12. During or after the controller 128 completes the set-up of the machine, the operator loads coin and paper for the wrapping mode or loads coin and attaches a bag for the bagging mode (step 182). Next, the operator presses the "START" key to commence wrapping or bagging (steps 184 and 186). As shown in FIGS. 9 and 12, the operational screen displays that the machine is wrapping (FIG. 9) or bagging (FIG. 12).

The machine continues wrapping or bagging until one of the following four events takes place. First, the machine stops wrapping or bagging in response to the operator pressing the "STOP" key (steps 188 and 190). FIG. 10 illustrates the operational screen after the machine has been stopped. Second, if the operator previously entered a "roll batch stop" count in conjunction with the wrapping mode, the machine stops at this preset "roll batch stop" count (step 192). Third, in the bagging mode the machine stops at the preset "batch stop count" (step 194). The operator must then remove the bag filled with the batch and attach a new bag to the machine (step 196). Fourth, in response to an operational error (step 198), the machine stops operation with a message indicating the type and location of the fault (step 200). FIG. 13, for example, describes the occurrence of a coin jam in the coin stacker of the machine. The operator then corrects the fault and presses the "RESET" key to clear the fault (steps 202 and 204). To resume operation following any of the foregoing types of stoppages, the operator presses the "START" key (step 206).

Figure 14:
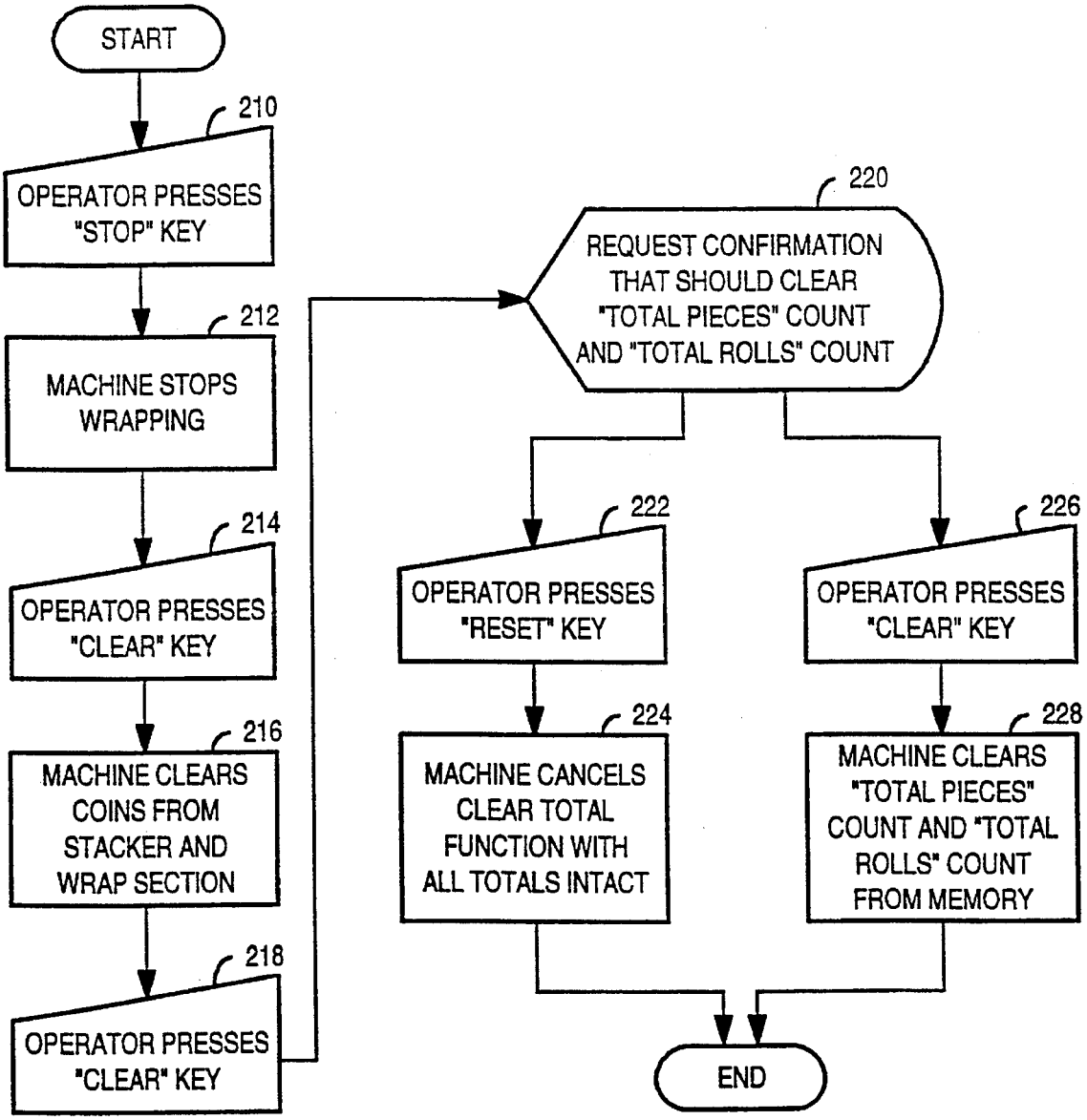
FIG. 14 is a flow diagram showing an interactive process for clearing coins and coin counts from the coin wrapping system while the controller in FIG. 3 is in a basic operating mode.
Figure 21A:
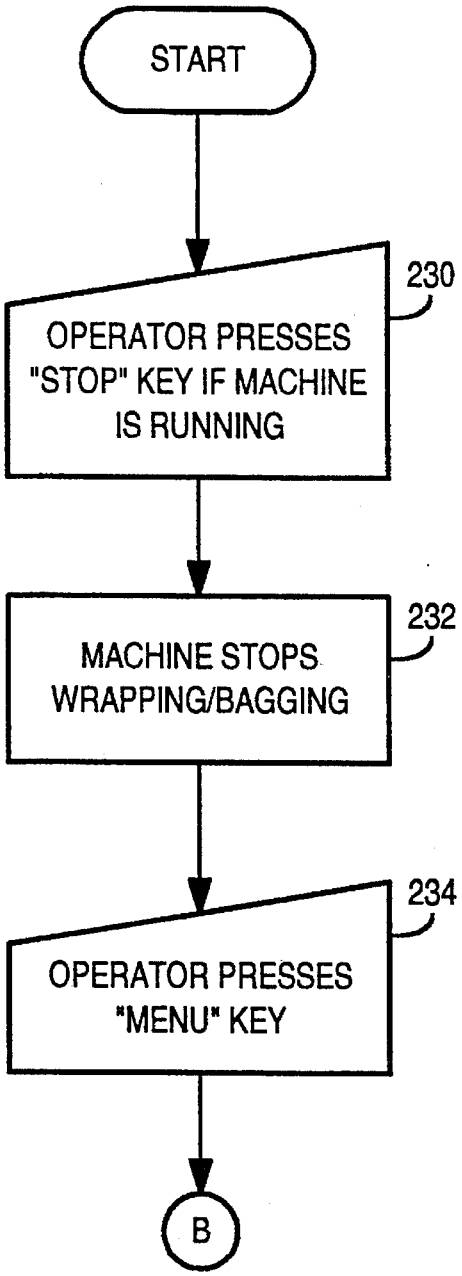
FIGS. 21*a–d* is a flow diagram showing an interactive process for operating the controller in a memory recall mode, an adjustment for wrap quality mode, a diagnostics mode, and a programming mode.
Figure 21B:
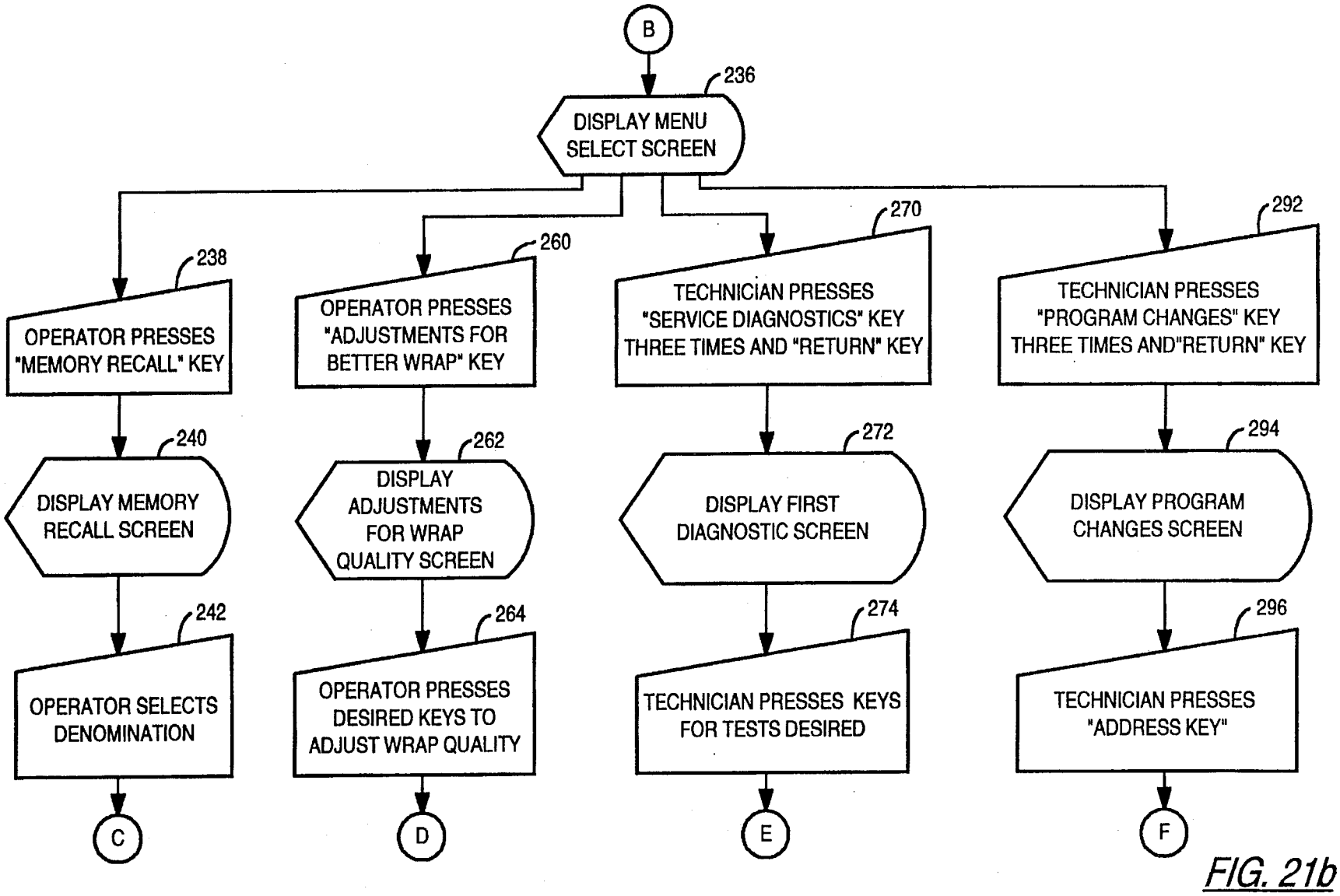
Figure 21C:
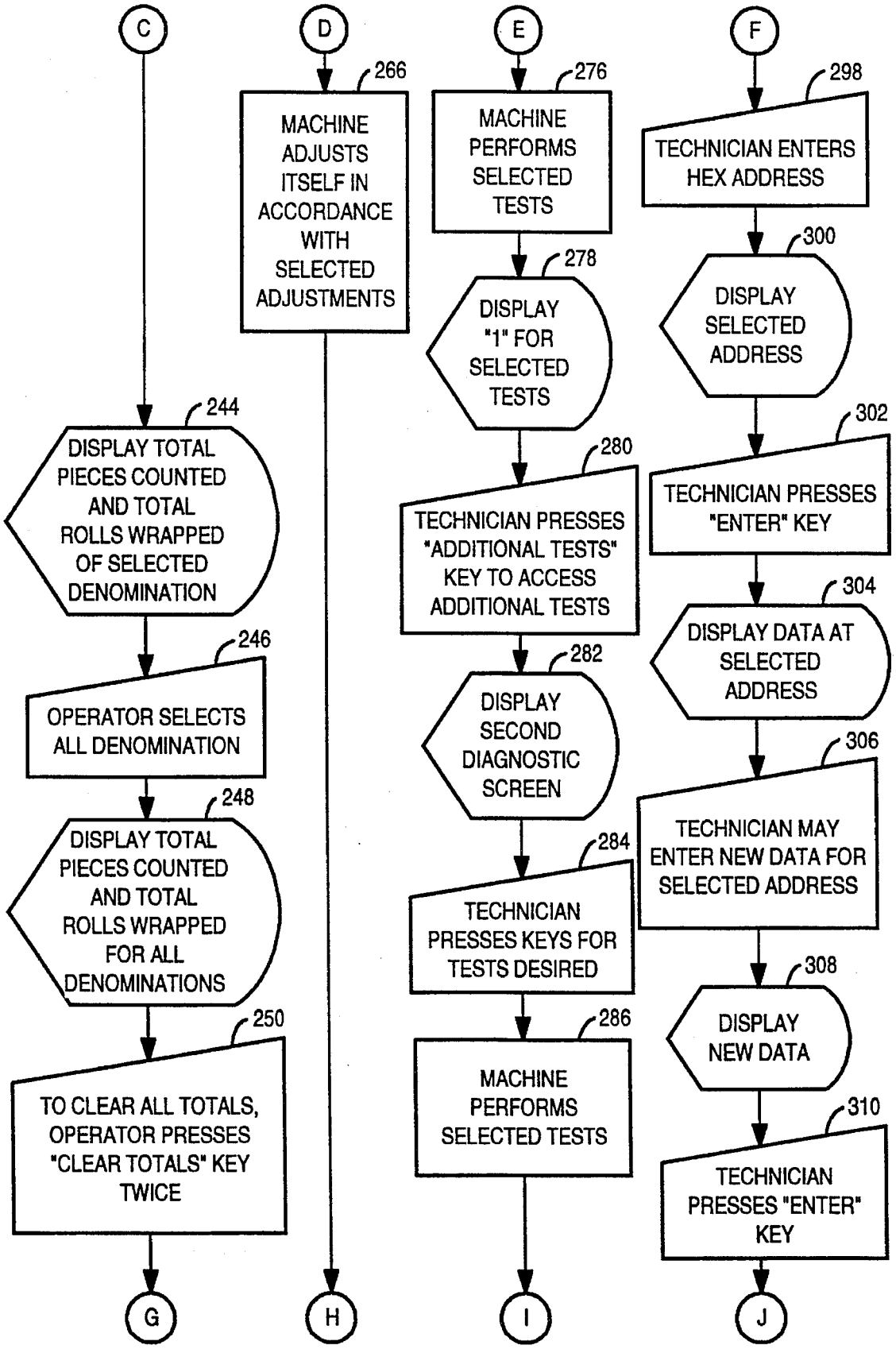
Figure 21D:
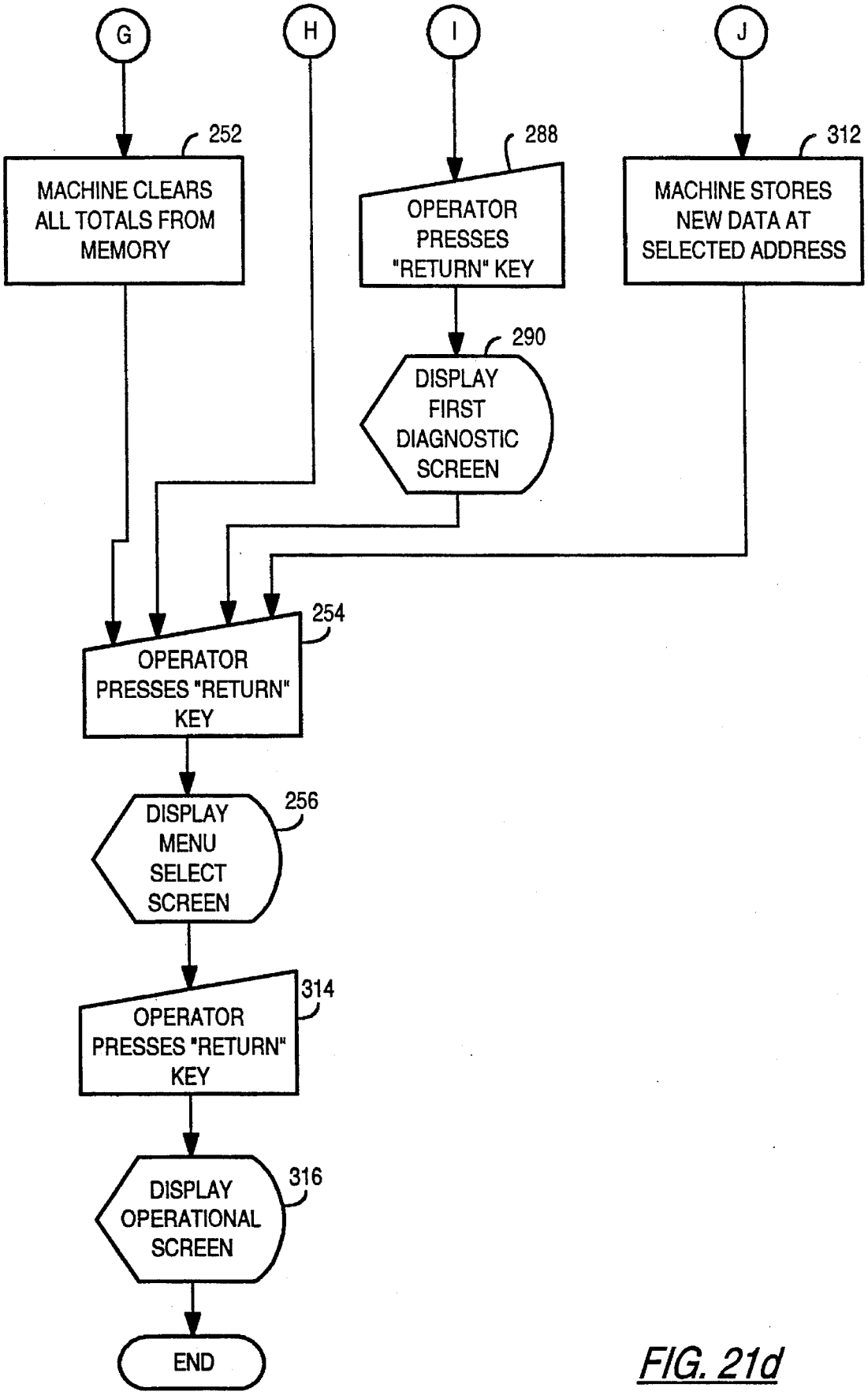

While the coin wrapping mechanism is in the basic operating mode, the operator can clear coins from the stacker and clear coin counts. Referring to FIG. 14, to clear coins from the stacker, the operator first stops the operation of the machine by pressing the "STOP" key on the operational screen (steps 210 and 212). FIG. 15 illustrates the operational screen after the operator has pressed the "STOP" key. Next, the operator presses the "CLEAR" key (step 214). In response to pressing the "CLEAR" key, the machine clears coins from its coin stacker and wrapping sections (step 216). As depicted in FIG. 16, the display 152 indicates that loose coins are being cleared from the machine.

To clear coin counts, such as "total pieces" count and "total rolls" count in the wrapping mode, the operator presses the "CLEAR" key a second time (step 218). This causes the display 152 to request confirmation that the machine should clear the "total pieces" count and "total rolls" count (step 220). As shown in FIG. 17, the display 152 may inquire, "Are you sure? You are clearing totals." At this point, the operator has two options. First, the operator may press the "RESET" key to cause the machine to cancel the clear coin counts function and leave the coin counts intact (steps 222 and 224). As depicted in FIG. 18, the display 152 only indicates that coins have been cleared, not that coin counts have been cleared. Second, the operator may press the "CLEAR" key a third time to cause the machine to clear the "total pieces" count and "total rolls" count from the memory 131 of the controller 128 (steps 226 and 228). As depicted in FIG. 20, the display 152 indicates on the operational screen that coin counts/totals have been cleared.

The operator may wish to maintain a record of the "total pieces" count and "total rolls" count for both a current batch of coins and multiple batches of coins. The "total pieces" count and "total rolls" count on the operational screens in FIGS. 15–20 pertain to the current batch of coins. After processing a batch of coins, these current counts are cleared in the manner described above, i.e., pressing the "CLEAR" key three times in succession. To maintain a cumulative record of the "total pieces" count and "total rolls" count for multiple batches of coins, the operator presses the "ADD" key. Pressing the "ADD" key adds the "total pieces" count and "total rolls" count to locations in the memory 131 dedicated to cumulative totals for the "total pieces" count and "total rolls" count, by denomination and by grand total of all denominations. After the operator presses the "ADD" key, the controller 128 generates a message on the operational screen that the totals have been added to memory (FIG. 20). These cumulative totals for the "total pieces" count and "total rolls" count may be viewed on a memory recall screen described below.

In addition to the basic operating mode, the controller 128 can cooperate with the much screen 150 and display 152 to operate in a memory recall mode, an adjustment for wrap quality mode, a diagnostics mode, and a programming mode. Referring to FIGS. 21*a–d,* to enter one of the foregoing four modes, the operator first presses the "STOP" key on the operational screen if the machine is running (step 230; FIGS. 9 or 12). After the machine stops running (step 232; FIG. 10), the operator presses the "MENU" key on the operational screen to cause the controller 128 to generate a menu select screen as shown in FIG. 22 (steps 234 and 236). The operator may now select either the memory recall mode, the adjustment for wrap quality mode, the diagnostics mode, or the programming mode. s To enter the memory recall mode, the operator presses the "MEMORY RECALL" key on the menu select screen in FIG. 22 (step 238). In response to pressing the "MEMORY RECALL" key, the controller 128 generates a memory recall screen on the display 152 as illustrated in FIG. 23 (step 240). The memory recall screen allows the operator to view "total pieces" counted and "total rolls" wrapped for a particular denomination or for all denominations. To view "total pieces" counted and "total rolls" wrapped for a particular denomination, the operator presses the appropriate denomination key (step 242). Pressing a denomination key causes the display 152 to show "total pieces" counted and "total rolls" wrapped for the selected denomination (step 244; FIG. 23). To view "total pieces" counted and "total rolls" wrapped for all denominations, the operator presses the "ALL DENOMINATIONS" key (step 246). As shown in FIG. 24, this causes the display 152 to show "total pieces" counted and "total rolls" wrapped for all denominations (step 248). If the operator wishes to clear all totals to zero, the operator presses the "CLEAR TOTALS" key twice in succession (step 250). After the first depression, the display 152 requests confirmation from the operator (FIG. 24). Pressing the "CLEAR TOTALS" key a second time clears all totals to zero. As shown in FIG. 26, the display 152 then indicates that all totals are clear (step 252). Instead of pressing the "CLEAR TOTALS" key a second time, the operator can press the "ALL DENOMINATIONS" key to cancel the clear totals command. Alternatively, the display 152 may be provided with a "CANCEL" key to cancel the clear totals command. To return to the menu select screen from the memory recall screen, the operator presses the "RETURN" key on the memory recall screen (steps 254 and 256).

To enter the adjustment for wrap quality mode from the menu select screen in FIG. 22, the operator presses the "ADJUSTMENTS FOR BETTER WRAP" key on the menu select screen (step 260). In response to pressing the "ADJUSTMENTS FOR BETTER WRAP" key, the display 152 shows the adjustments for wrap quality screen as illustrated in FIG. 27 (step 262). This screen allows the operator to fine tune mechanical adjustments to accommodate odd sized paper or "over or under" sized coins such as tokens. Any adjustments made by the operator using the adjustments for wrap quality screen apply to the denomination for which the machine has been configured. Therefore, a denomination must be selected on the denomination select and mode set-up screen (FIG. 7) prior to performing adjustments with respect to that denomination. The adjustments for wrap quality screen permits the operator to modify three areas from the default programmed settings: diameter, thickness, and paper feed length.

Since the machine is set up for a particular denomination requiring modification, all the operator needs to do is press the appropriate key to make a change (step 264). For example, to increase the width of the coin track which delivers coins to the coin stacker so as to allow a slightly larger coin to be processed, the operator merely presses the "WIDER" key in FIG. 27. If more wrapping paper needs to be wrapped around a roll of coins, the operator presses the "LONGER" key. The machine adjusts itself in accordance with the selected modifications (step 266), and the display 152 shows the modified settings as depicted in FIG. 28. In the preferred embodiment, any adjustments from the default settings are not cleared by any default function. Instead, changes back to the default settings are accomplished by reversing the modified settings. To return to the menu select screen from the adjustments for wrap quality screen, the operator presses the "RETURN" key on the adjustments for wrap quality screen (steps 254 and 256).

To enter the diagnostics mode from the menu select screen in FIG. 22, the operator (e.g., service technician) presses the "SERVICE DIAGNOSTICS" key on the menu select screen three times in rapid succession followed by the "RETURN" key (step 270). In response to pressing the "SERVICE DIAGNOSTICS" key three consecutive times followed by the "RETURN" key, the display 152 shows the diagnostics screen illustrated in FIG. 29 (step 272). The diagnostics screen in FIG. 29 allows a service technician to test several functions of the machine, either individually or in combination with one another. Switches and sensors are activated by the technician (step 274). A "0" on the display 152 converts to a "1" when a switch is activated and is working properly. For example, when adjustment is required for the coin "level sensor", the technician goes into the diagnostics mode to make the adjustment, watching the display 152 for the "1" when the switch is in the correct position by the technician. Motors and solenoids are activated by pressing the key for the desired test. The "0" on the diagnostics screen converts to a "1" in response to activating the test (step 278). The technician can activate as many test functions as desired. Once the desired tests are activated, the machine performs the selected tests (step 276).

The technician presses the "ADDITIONAL TESTS" key on the diagnostics screen in FIG. 29 to access additional tests (step 280). In response to pressing the "ADDITIONAL TESTS" key, the display 152 shows a second diagnostics screen as depicted in FIG. 30 (step 282). Using this second diagnostics screen, the technician presses keys associated with desired tests to cause the machine to perform those tests (steps 284 and 286). For example, the "MAIN MOTOR CONT." key allows the technician to test and cycle the main motor 112 (FIG. 3) which drives the elliptical cam 100. Using the "MAIN MOTOR STEPPING" key, the technician can also step the main motor 112 in increments of degrees to check the various positions of the elliptical cam 100 and associated parts driven by the cam 100. Furthermore, the technician can test and adjust as required the servos used to set the width and height of the coin track. The "PLUS" and "MINUS" keys associated with the adjustment keys are used to respectively increase and decrease the dimension. The display 152 will show the dimension in inches and can be converted to metric units. The display 152 will also show the value in Hex units for programming purposes.

To return to the first diagnostics screen in FIG. 29 from the second diagnostics screen in FIG. 30, the operator presses the "RETURN" key on the adjustments for wrap quality screen (steps 288 and 290). Pressing the "RETURN" key on the first diagnostics screen returns the display 152 to the menu select screen (steps 254 and 256).

To enter the programming mode from the menu select screen in FIG. 22, the operator (e.g., service technician) presses the "PROGRAM CHANGES" key on the menu select screen three times in rapid succession followed by the "RETURN" key (step 292). The programming mode is intended only for service personnel. In response to pressing the "PROGRAM CHANGES" key three consecutive times followed by the "RETURN" key, the display 152 shows the program changes screen illustrated in FIG. 31 (step 294). The program changes screen in FIG. 31 allows the technician to make changes to the program running in the memory 131 (includes RAM), which makes the changes semi-permanent unless the machine is put through a default function. The programming mode is particularly useful when a customer has a special coin to wrap. The particular measurements and data associated with the special coin can be programmed into the memory 131, thus allowing for customization of the coin wrapping mechanism. Changes to the standard coin set program can also be performed if the customer wraps a high quantity of mint coins. Mint coins might have different dimensions from circulated coins. The different dimensions of mint coins relative to circulated coins can cause problems in wrapping. Therefore, making a change to the standard coin set program avoids such wrapping problems and tailors the machine to the customer.

To initiate a programming change, the technician first presses the "ADDRESS" key in FIG. 31 (step 296). Next, using the alphanumeric keypad on the display 152, the technician enters a hex address (step 298). The hex address is displayed adjacent to the "ADDRESS" key as illustrated in FIG. 32 (step 300). Pressing the "ENTER" key causes the controller 128 to show the data at that hex address in the "CONTENTS" line of the display 152 (steps 302 and 304; FIG. 32). To change the displayed contents of the selected hex address, the technician enters new data using the alphanumeric keypad and presses the "ENTER" key (steps 306, 308 and 310). The controller 128 stores the new data in the memory 131 at the selected hex address (step 312). The technician can change the contents of other hex addresses in similar fashion. To return to the menu select screen from the program changes screen, the operator presses the "RETURN" key on the program changes screen (steps 254 and 256).

The memory recall mode, adjustment for wrap quality mode, diagnostics mode, and programming mode illustrate the flexibility, versatility, and user friendliness of the touch screen device 130. To return to the operational screen in FIG. 10 from the menu select screen in FIG. 22, the operator presses the "RETURN" key on the menu select screen (steps 314 and 316). This returns the controller 128 to the basic operating mode.

In conjunction with the touch screen device 130, the controller 128 can create a hierarchy of display patterns for display on the display 152. The display patterns may include display fields with textual information, numerical information, data entry prompts, or keys actuated via the touch screen 150. The touch screen device 130 and controller 128 permit a virtually unlimited number of keys to be displayed on the display 152, the number of keys being constrained primarily by the capacity of the memory 131 in the controller 128. Movement from one display pattern to the next is achieved by pressing a key, such as a "MORE" key or a "BACK" key, displayed on the current display pattern. Such a large number of keys would occupy an inordinate amount of space if formed as part of a mechanical keyboard.

In an alternative embodiment, the controller 128 and touch screen device 130 are used to customize data entry fields, modify (edit) key legends, display key legends and other textual information in different languages, delete (disable) or add (enable) keys or functions displayed on the display 152, and reposition keys displayed on the display 152. In addition, the controller 128 and touch screen device 130 may be employed to modify the complexity of the display patterns on the display 152 to match the level of experience of the operator. For example, a novice may prefer a large number of relatively simple display patterns while a more experienced operator may prefer a small number of relatively complex display patterns. Further information concerning the use of a controller and touch screen device for the aforementioned purposes is described and illustrated in copending U.S. patent application Ser. No. 08/301,343 entitled "Coin Sorting System With Touch Screen Device", filed Sep. 6, 1994, and incorporated herein by reference.

While the present invention has been described with reference to one or more particular embodiments, those skilled in the art will recognize that many changes may be made thereto without departing from the spirit and scope of the present invention. For example, the coin wrapping system may employ coin wrapping mechanisms other than the coin wrapping mechanism illustrated in FIGS. 1–4. Each of these embodiments and obvious variations thereof is contemplated as falling within the spirit and scope of the claimed invention, which is set forth in the following claims.

What is claimed is:

1. A coin wrapping system, comprising:

a coin wrapping mechanism forming a coin stack containing a predetermined number of coins of a preselected denomination and wrapping a wrapping material about the coin stack to form a wrapped roll of coins;

an operator interface panel including a display and a touch screen mounted over the display;

a controller coupling the operator interface panel to the coin wrapping mechanism, the controller causing the display to display keys thereon, the controller operably coupling the touch screen to the displayed keys such that actuation of the touch screen at a position above one of the displayed keys causes the controller to execute a coin wrapping mechanism function associated with the one of the displayed keys, the controller being operable, via the touch screen, in a plurality of modes, the controller causing the display to display data and sets of keys associated with respective ones of the modes; and a memory coupled to the controller, the memory storing the data associated with respective ones of the modes.

2. The coin wrapping system of claim 1, wherein the plurality of modes include a basic operating mode.

3. The coin wrapping system of claim 2, wherein the displayed set of keys associated with the basic operating mode includes a start key for activating the coin wrapping mechanism, a stop key for deactivating the coin wrapping mechanism, and denomination keys for preselecting the denomination of the coins to be wrapped with the coin wrapping mechanism.

4. The coin wrapping system of claim 3, wherein the displayed set of keys associated with the basic operating mode includes a numeric keypad for selecting a batch stop quantity, the controller causing the coin wrapping mechanism to stop after wrapping a number of rolls equal to the batch stop quantity.

5. The coin wrapping system of claim 3, wherein the data stored in the memory includes a current total of wrapped rolls of coins generated with the coin wrapping mechanism for the preselected denomination and a current total of coins wrapped into the rolls of coins for the preselected denomination, and wherein the displayed set of keys associated with the basic operating mode includes a clear key for clearing the current total of wrapped rolls and the current total of coins wrapped into the rolls.

6. The coin wrapping system of claim 1, wherein the data stored in the memory includes a cumulative total of wrapped rolls of coins generated with the coin wrapping mechanism for each denomination and all denominations combined and a cumulative total of coins wrapped into the rolls of coins for each denomination and all denominations combined, wherein the plurality of modes includes a memory recall mode, and wherein the displayed data associated with the memory recall mode includes the cumulative total of wrapped rolls of coins and the cumulative total of coins wrapped into the rolls.

7. The coin wrapping system of claim 6, wherein the displayed set of keys associated with the memory recall mode includes a clear key for clearing the cumulative total of wrapped rolls and the cumulative total of coins wrapped into the rolls.

8. The coin wrapping system of claim 1, wherein the plurality of modes includes an adjustment for wrap quality mode, and wherein the displayed set of keys associated with the adjustment for wrap quality mode permit an operator to modify one or more adjustable operating parameters which affect the quality of the wrapped roll of coins.

9. The coin wrapping system of claim 1, wherein the plurality of modes includes a diagnostics mode, and wherein the displayed set of keys associated with the diagnostics mode permit an operator to test a plurality of operations of the coin wrapping mechanism.

10. The coin wrapping system of claim 1, wherein the plurality of modes includes a programming mode, and wherein the displayed set of keys associated with the programming mode permit an operator to access and modify addresses in the memory containing data specifying size and quantity of the coins in the coin stack.

11. A coin wrapping system, comprising:

a coin wrapping mechanism including a stacker forming a coin stack containing a predetermined number of coins of a preselected denomination and a wrapper section wrapping a wrapping material about the coin stack to form a wrapped roll of coins;

an operator interface panel including a display and a touch screen mounted over the display;

a controller coupling the operator interface panel to the coin wrapping mechanism, the controller causing the display to display keys thereon, the controller operably coupling the touch screen to the displayed keys such that actuation of the touch screen at a position above one of the displayed keys causes the controller to execute a coin wrapping mechanism function associated with the one of the displayed keys, the controller being operable, via the touch screen, in a plurality of modes, the plurality of modes including a basic operating mode, a memory recall mode, an adjustment for wrap quality mode, a diagnostics mode, and a programming mode, the controller causing the display to display data and sets of keys associated with respective ones of the modes; and a memory coupled to the controller, the memory storing the data associated with respective ones of the modes.

12. The coin wrapping system of claim 11, wherein the displayed set of keys associated with the basic operating mode permits an operator to activate and deactivate the coin wrapping mechanism and to preselect the denomination of the coins to be wrapped with the coin wrapping mechanism.

13. The coin wrapping system of claim 12, wherein the displayed data associated with the basic operating mode includes the activated/deactivated status of the coin wrapping mechanism; the preselected denomination of the coins wrapped with the coin wrapping mechanism; a current total of wrapped rolls of coins generated with the coin wrapping mechanism for the preselected denomination; and a current total of coins wrapped into the rolls of coins for the preselected denomination.

14. The coin wrapping system of claim 12, wherein the displayed data associated with the basic operating mode includes error information in response to the coin wrapping mechanism entering an error condition.

15. The coin wrapping system of claim 11, wherein the displayed data associated with the memory recall mode includes a cumulative total of wrapped rolls of coins generated with the coin wrapping mechanism for each denomination and all denominations combined and a cumulative total of coins wrapped into the rolls of coins for each denomination and all denominations combined.

16. The coin wrapping system of claim 15, wherein the displayed set of keys associated with the memory recall mode includes a clear key for clearing the cumulative total of wrapped rolls and the cumulative total of coins wrapped into the rolls.

17. The coin wrapping system of claim 11, wherein the displayed set of keys associated with the adjustment for wrap quality mode permit an operator to modify one or more adjustable operating parameters which affect the quality of the wrapped roll of coins.

18. The coin wrapping system of claim 17, wherein the displayed data associated with the adjustment for wrap quality mode includes current settings of the adjustable operating parameters.

19. The coin wrapping system of claim 11, wherein the displayed set of keys associated with the diagnostics mode permit an operator to test a plurality of operations of the coin wrapping mechanism.

20. The coin wrapping system of claim 11, wherein the displayed set of keys associated with the programming mode permit an operator to access and modify addresses in the memory containing data specifying size and quantity of the coins in the coin stack.

21. A method for operating a coin wrapping system including (a) a coin wrapping mechanism forming a coin stack containing a predetermined number of coins of a preselected denomination and wrapping a wrapping material about the coin stack to form a wrapped roll of coins, (b) an operator interface panel including a display and a touch screen mounted over the display, and (c) a controller coupling the operator interface panel to the coin wrapping mechanism, the controller causing the display to display keys thereon, the controller operably coupling the touch screen to the displayed keys, the method comprising the steps of:

displaying, under direction of the controller, data and a set of keys on the display associated with one of a plurality of controller operation modes;

actuating the touch screen at a position above one of the displayed keys; and executing, under direction of the controller, a coin wrapping mechanism function associated with the one of the displayed keys.

22. The method of claim 21, wherein the plurality of modes include a basic operating mode, a memory recall mode, an adjustment for wrap quality mode, a diagnostics mode, and a programming mode.

23. A coin wrapping system, comprising:

a coin wrapping mechanism including a stacker forming a coin stack containing a predetermined number of coins of a preselected denomination and a wrapper section wrapping a wrapping material about the coin stack to form a wrapped roll of coins;

an operator interface panel including a display and a touch screen mounted over the display;

a controller coupling the operator interface panel to the coin wrapping mechanism, the controller causing the display to display keys thereon, the controller operably coupling the touch screen to the displayed keys such that actuation of the touch screen at a position above one of the displayed keys causes the controller to execute a coin wrapping mechanism function associated with the one of the displayed keys, the controller being operable, via the touch screen, in a basic operating mode, a memory recall mode, an adjustment for wrap quality mode, a diagnostics mode, and a programming mode, the controller causing the display to display data and sets of keys associated with respective ones of the modes, the controller testing mechanical elements of the coin wrapping mechanism in response to the touch screen being pressed above the set of keys associated with the diagnostics mode; and a memory coupled to the controller, the memory storing the data associated with respective ones of the modes, the stored data including a total of wrapped rolls of coins generated with the coin wrapping mechanism for a preselected denomination and a total of coins wrapped into the rolls of coins for the preselected denomination;

wherein the displayed set of keys associated with the basic operating mode include a start key, a stop key, denomination keys, a numeric keypad, and a clear key, the controller activating the coin wrapping mechanism in response to the touch screen being pressed above the start key, the controller deactivating the coin wrapping mechanism in response to the touch screen being pressed above the stop key, the controller preselecting the denomination of the coins to be wrapped with the coin wrapping mechanism in response to the touch screen being pressed above one of the denomination keys, the controller deactivating the coin wrapping mechanism in response to wrapping a number of rolls entered into the memory via the numeric keypad, the controller clearing the total of wrapped rolls and the total of coins wrapped into the rolls in response to the clear key being pressed a predetermined number of times.

24. The coin wrapping system of claim 23, wherein said mechanical elements include one or more motors and one or more sensors.

* * * * *